US006905382B2

(12) United States Patent
Ochiai et al.

(10) Patent No.: US 6,905,382 B2
(45) Date of Patent: Jun. 14, 2005

(54) SHIFT DEVICE FOR MARINE TRANSMISSION

(75) Inventors: Katsumi Ochiai, Hamamatsu (JP); Masanori Takahashi, Hamamatsu (JP)

(73) Assignee: Yamaha Marine Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 10/689,343

(22) Filed: Oct. 20, 2003

(65) Prior Publication Data

US 2004/0082235 A1 Apr. 29, 2004

(30) Foreign Application Priority Data

| | | |
|---|---|---|
| Oct. 21, 2002 | (JP) | 2002-305391 |
| Dec. 20, 2002 | (JP) | 2002-370012 |
| May 13, 2003 | (JP) | 2003-134025 |

(51) Int. Cl.[7] ..... B60K 41/00

(52) U.S. Cl. ..... 440/86; 74/473.12; 477/107

(58) Field of Search ..... 440/1, 75, 84, 440/85, 86, 87; 477/107, 111, 165; 74/469, 473.1, 473.12, 473.15, 473.3, 480.3, 500.5, 502.4; 192/51

(56) References Cited

U.S. PATENT DOCUMENTS

| | | | | |
|---|---|---|---|---|
| 4,527,441 A | | 7/1985 | Nakahama | 74/378 |
| 4,579,204 A | | 4/1986 | Iio | 192/21 |
| 5,050,461 A | | 9/1991 | Onoue et al. | 74/872 |
| 5,051,102 A | | 9/1991 | Onoue | 440/75 |
| 5,242,320 A | * | 9/1993 | Schmidt et al. | 440/86 |
| 5,318,466 A | * | 6/1994 | Nagafusa | 440/86 |
| 5,408,230 A | * | 4/1995 | Okita | 440/84 |
| 5,445,546 A | | 8/1995 | Nakamura | 440/75 |
| 5,692,931 A | | 12/1997 | Kawai | 440/86 |
| 5,910,191 A | | 6/1999 | Okamoto | 74/473 |
| 6,015,319 A | | 1/2000 | Tanaka | 440/84 |
| 6,098,591 A | | 8/2000 | Iwata | 123/339.11 |
| 6,217,400 B1 | | 4/2001 | Natsume | 440/75 |
| 6,238,255 B1 | * | 5/2001 | Takase | 440/1 |
| 6,485,340 B1 | * | 11/2002 | Kolb et al. | 440/84 |
| 6,692,320 B1 | * | 2/2004 | Sawyer | 440/86 |

FOREIGN PATENT DOCUMENTS

| | | |
|---|---|---|
| JP | 7-17486 | 1/1995 |
| JP | 2817738 | 8/1998 |
| JP | 2890471 | 2/1999 |

OTHER PUBLICATIONS

Co–pending U.S. Appl. No. 10/624,204, filed Jul. 22, 2003, Okuyama, Takashi, "Control Circuits And Methods For Inhibiting Abrupt Engine Mode Transitions In A Watercraft.".

* cited by examiner

*Primary Examiner*—S. Joseph Morano
*Assistant Examiner*—Lars A. Olson
(74) *Attorney, Agent, or Firm*—Knobbe, Martens, Olson & Bear LLP

(57) ABSTRACT

A marine drive has a propulsion device. A transmission is coupled with the propulsion device. A shift mechanism moves the transmission between a first position in which the propulsion device is set to a first mode and a second position in which the propulsion device is set to a second mode. The shift mechanism has a shift unit movable between a first shift position and a second shift position. The transmission moves to the first position while the shift unit moves toward the first shift position, and moves to the second position while the shift unit moves toward the second shift position. An electrically operable shift actuator is supported by the drive body. The shift actuator has an actuating member that preferably is detachably coupled with the shift unit.

28 Claims, 35 Drawing Sheets

SHIFT DEVICE FOR MARINE TRANSMISSION

PRIORITY INFORMATION

The present application is based on and claims priority under 35 U.S.C. § 119 to Japanese Patent Applications Nos. 2002-305391, filed on Oct. 21, 2002; 2002-370012, filed on Dec. 20, 2002; and 2003-134025, filed on May 13, 2003, the entire content of which are expressly incorporated by reference herein.

BACKGROUND OF THE INVENTION

1. Field of the Invention

The present invention generally relates to a shift device for marine transmission, and more particularly relates to an improved shift device that has a shift member to move a transmission between at least two positions.

2. Description of Related Art

Marine drives such as, for example, outboard motors are disposed at a stern of an associated watercraft. The outboard motors incorporate a propulsion device that propels the watercraft. The propulsion device typically is a propeller. A transmission is incorporated to couple the propulsion device with a prime mover such as, for example, an engine that powers the propulsion device. A shift mechanism also is incorporated to move the transmission among forward, reverse and neutral positions that correspond to forward, reverse and neutral modes of the propulsion device, respectively. The propulsion device can propel the watercraft forwardly when the transmission is set in the forward position, while the propulsion device can propel the watercraft rearwardly when the transmission is set in the reverse position. The propulsion device usually does not propel the watercraft when the transmission is set in the neutral position because the propulsion device typically is disconnected from the prime mover in this position.

Typically, a remote controller that is placed in a cockpit of the watercraft remotely operates the shift mechanism. Due to being separately located from each other, a control lever of the remote controller can be connected to the shift mechanism through a mechanical cable. For example, U.S. Pat. Nos. 5,050,461, 5,051,102, 6,015,319, 6,098,591 and Japanese Patent Publication 7-17486 disclose a mechanical shift control system that operates between the remote controller and the shift mechanism.

Such a mechanical shift control system is durable and reliable; however, such a system also needs a relatively long cable that requires relatively large space and is burdensome to install and repair.

An electrical shift control system can replace the mechanical shift control system to actuate the shift mechanism. In one arrangement, the movement of the control lever of the remote controller is electrically sensed and is sent to a control device as a shift position command. The control device controls the actuator based upon the shift position command such that the shift mechanism moves the transmission in accordance with the movement of the control lever.

The electrical shift control system does not need the mechanical cable. However, if the electrical shift control system falls into an abnormal condition, it can be difficult to shift the transmission. Users of an outboard motor thus may prefer one system over the other and, thus, may want to change a mechanical shift control system to an electrical shift control system, or vice versa. In such an exchange, for example, the mechanical cable is replaced by a shift actuator or, conversely, the shift actuator is replaced by the mechanical cable. A need therefore exists for an improved shift device that can be easily changed to the mechanical shift control system from the electrical shift control system and vice versa.

Generally, marine drives such as the outboard motors can have very limited space for their internal components because of the compact size of the outboard motor. A shift actuator, however, is normally required to be placed at a location near the shift mechanism of the outboard motor. Another need thus exists for an improved shift device that can arrange the shift actuator in the limited space while generally preserving the compact size of the outboard motor.

SUMMARY OF THE INVENTION

In accordance with one aspect of the present invention, a marine drive comprises a drive body. A propulsion device extends from the drive body. A transmission is coupled with the propulsion device. A shift mechanism is arranged to move the transmission between a first position in which the propulsion device is set to a first operational mode and a second position in which the propulsion device is set to a second operational mode. The shift mechanism comprises a shift unit linearly movable between a first shift position and a second shift position. The transmission moves to the first position while the shift unit moves toward the first shift position. The transmission moves to the second position while the shift unit moves toward the second shift position. An electrically operable shift actuator supported by, and more preferably disposed on, the drive body. The shift actuator has an actuating member detachably coupled to the shift unit.

In accordance with another aspect of the present invention, a marine drive comprises a drive body. A propulsion device extends from the drive body. A transmission is coupled with the propulsion device. A shift mechanism is arranged to move the transmission between a first position in which the propulsion device is set to a first mode and a second position in which the propulsion device is set to a second mode. The shift mechanism comprises a shift unit pivotally movable between a first shift position and a second shift position. The transmission moves to the first position while the shift unit moves toward the first shift position, the transmission moves to the second position while the shift unit moves toward the second shift position. An electrically operable shift actuator is supported by the drive body. The shift actuator has a rotary shaft and an actuating member coupled with the rotary shaft and with the shift unit.

In accordance with a further aspect of the present invention, a marine drive comprises a drive body. A propulsion device extends from the drive body. A transmission is coupled with the propulsion device. A shift mechanism is arranged to move the transmission between a first position in which the propulsion device is set to a first mode and a second position in which the propulsion device is set to a second mode. The shift mechanism comprises a shift unit pivotally movable between a first shift position and a second shift position. The transmission moves to the first position while the shift unit moves toward the first shift position. The transmission moves to the second position while the shift unit moves toward the second shift position. An electrically operable shift actuator is supported by the drive body. The shift actuator has a rotary shaft and an actuating member is coupled with the rotary shaft and with the shift unit. The actuating member comprises first and second sections pivotally coupled with each other. The first section linearly extends and retracts relative to a housing of the shift actuator along an axis of the first section. The second section is pivotally coupled with the shift unit.

In accordance with a further aspect of the present invention, a marine drive comprises a drive body. A propulsion device extends from the drive body. A transmission is coupled with the propulsion device. A shift mechanism is arranged to move the transmission between a first position in which the propulsion device is set to a first mode and a second position in which the propulsion device is set to a second mode. The shift mechanism comprises a shift unit pivotally movable between a first shift position and a second shift position. The transmission moves to the first position while the shift unit moves toward the first shift position. The transmission moves to the second position while the shift unit moves toward the second shift position. An electrically operable shift actuator is supported by the drive body. The shift actuator has a rotary shaft and an actuating member is coupled with the rotary shaft and the shift unit. The actuating member linearly extends and retracts relative to a housing of the shift actuator. The housing of the shift actuator is pivotally affixed to the drive body.

In accordance with a further aspect of the present invention, a marine drive comprises a drive body. A propulsion device extends from the drive body. A transmission is coupled with the propulsion device. A shift mechanism is arranged to move the transmission between a first position in which the propulsion device is set to a first mode and a second position in which the propulsion device is set to a second mode. The shift mechanism comprises a shift unit movable between a first shift position and a second shift position. The transmission moves to the first position while the shift unit moves toward the first shift position. The transmission moves to the second position while the shift unit moves toward the second shift position. An electrically operable shift actuator is supported by the drive body. The shift actuator has an actuating member coupled with the shift unit. A shift position sensor senses a position of the shift unit placed between the first and second shift positions.

In accordance with a further aspect of the present invention, a marine drive comprises a propulsion device. A prime mover powers the propulsion device. A transmission is coupled with the propulsion device. A shift mechanism is arranged to move the transmission between a first position in which the propulsion device is set to a first mode and a second position in which the propulsion device is set to a second mode. The shift mechanism comprises a shift unit movable between a first shift position and a second shift position. The transmission moves to the first position while the shift unit moves toward the first shift position. The transmission moves to the second position while the shift unit moves toward the second shift position. An electrically operable shift actuator has an actuating member coupled with the shift unit. The shift actuator is affixed onto a surface of the prime mover.

In accordance with a further aspect of the present invention, a watercraft comprises a marine drive, a shift operating device and a control device. The marine drive comprises a propulsion device. A transmission is coupled with the propulsion device. A shift mechanism is arranged to move the transmission between a first position in which the propulsion device is set to a first mode and a second position in which the propulsion device is set to a second mode. The shift mechanism comprises a shift unit movable between a first shift position and a second shift position. The transmission moves to the first position while the shift unit moves toward the first shift position. The transmission moves to the second position while the shift unit moves toward the second shift position. An electrically operable shift actuator has an actuating member coupled with the shift unit. The shift operating device provides a shift position command to the control device. The control device controls the shift actuator to move the actuating member based upon the shift position command. The shift operating device has a control member movable between a first control position corresponding to the first shift position and a second control position corresponding to the second shift position. A position sensor is arranged to sense a control position of the control member placed between the first and second control positions or a shift position of the shift unit placed between the first and second shift positions and to send a shift position command signal to the control device.

In accordance with a further aspect of the present invention, a watercraft comprises a marine drive, an internal combustion engine, a shift operating device and a control device. The marine drive comprises a propulsion device powered by the engine. A transmission is coupled with the propulsion device. A shift mechanism is arranged to move the transmission between a first position in which the propulsion device is set to a neutral mode and a second position in which the propulsion device is set to a propulsion mode. The propulsion device does not propel the watercraft in the neutral mode and propels the watercraft in the propelling mode. The shift mechanism comprises a shift unit movable between a first shift position and a second shift position. The transmission moves to the first position when the shift unit moves to the first shift position. The transmission moves to the second position when the shift unit moves to the second shift position. An electrically operable shift actuator has an actuating member coupled with the shift unit. The shift operating device provides a shift position command to the control device. The control device controls the shift actuator to move the actuating member based upon the shift position command. The shift operating device has a control member movable between a first control position corresponding to the first shift position and a second control position corresponding to the second shift position. A neutral position sensor is arranged to sense the control member placed at the first control position or the shift unit placed at the first shift position and to send a neutral position command signal to the control device.

BRIEF DESCRIPTION OF THE DRAWINGS

The foregoing and other features, aspects and advantages of the present invention are described in detail below with reference to the drawings of preferred embodiments which are intended to illustrate and not to limit the invention. The drawings comprise 35 figures in which.

DETAILED DESCRIPTION OF THE PREFERRED EMBODIMENTS OF THE INVENTION

Figure 1:
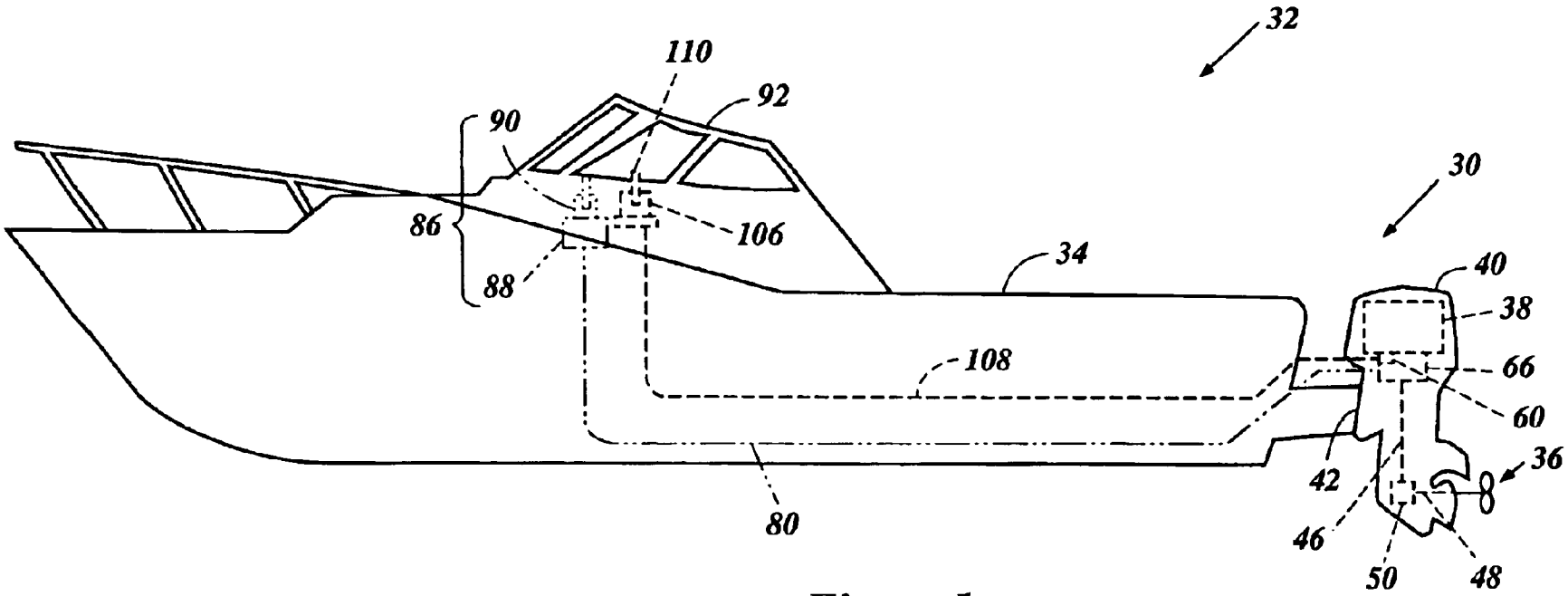
FIG. 1 illustrates a schematic representation of a side elevational view of a watercraft propelled by an outboard motor configured in accordance with certain features, aspects and advantages of the present invention.
Figure 2:
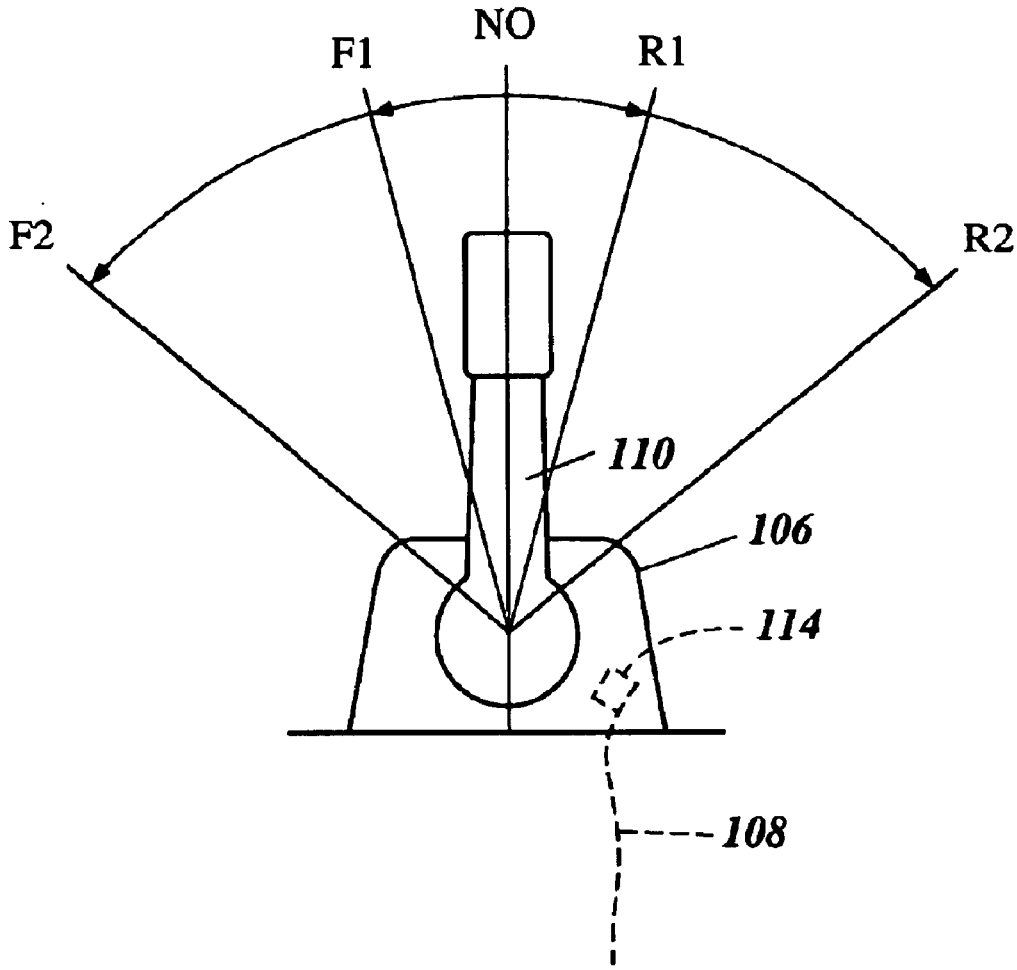
FIG. 2 illustrates a schematic representation of a side elevational view of a remote controller for the watercraft and the outboard motor of FIG. 1.
Figure 3:
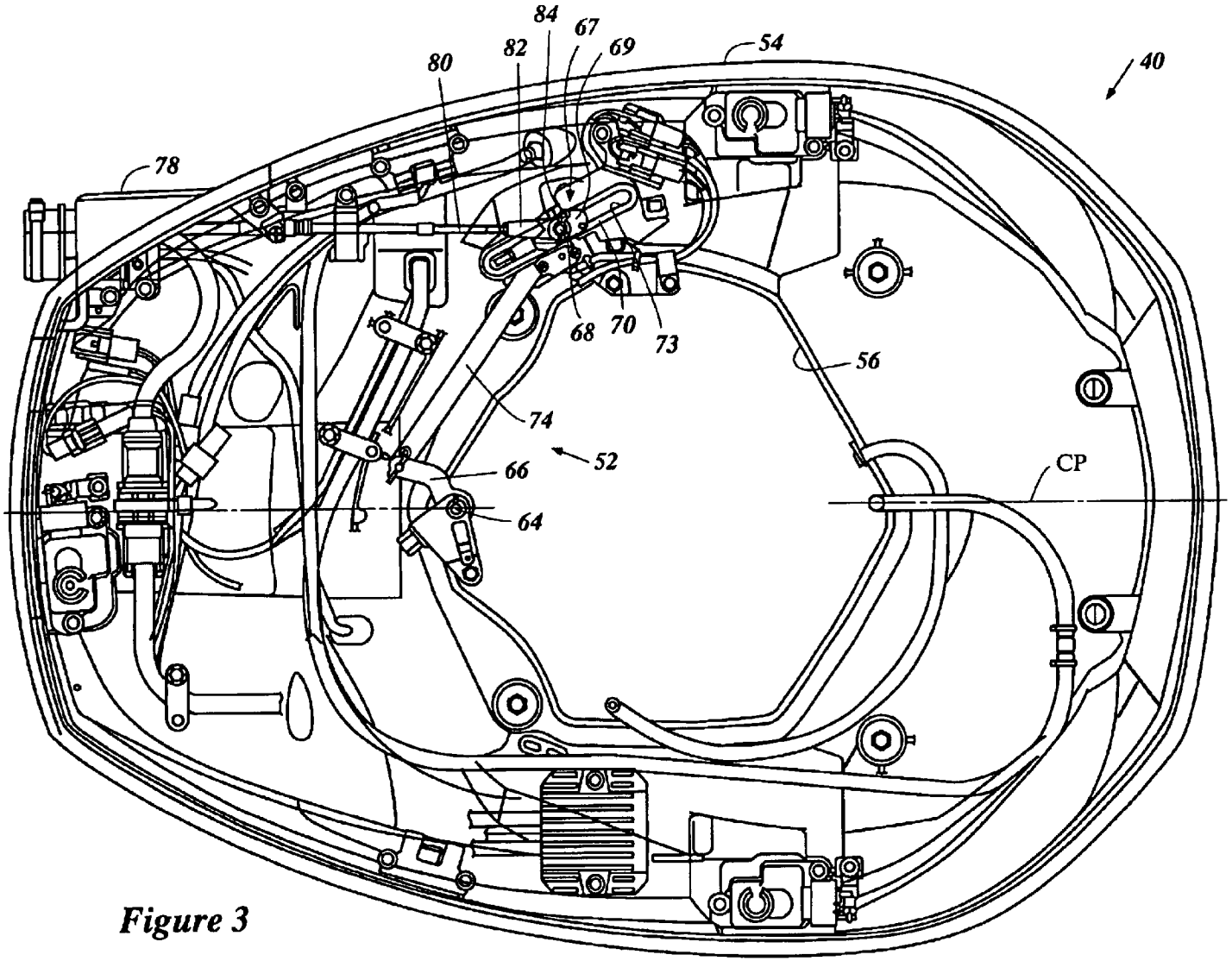
FIG. 3 illustrates a top plan view of the outboard motor with a top cowling member removed, wherein the outboard motor in this arrangement has a mechanical cable coupled with a shift unit of a shift mechanism of the outboard motor.

With reference to FIGS. 1–3, an outboard motor 30 that is configured in accordance with certain features, aspects and advantages of the present invention and an associated watercraft 32 are shown. The outboard motor 30 is a typical marine drive, and thus all the embodiments below are described in the context of an outboard motor. The embodiments, however, can be applied to other marine drives, such as, for example, inboard drives and inboard/outboard drives (or stern drives), as will become apparent to those of ordinary skill in the art.

With reference to FIG. 1, the watercraft 32 has a hull 34. The watercraft 32 carries the outboard motor 30 that has a propulsion device 36 and an internal combustion engine 38. The propulsion device 36 propels the watercraft 32 and the engine 38 powers the propulsion device 36. The outboard motor 30 comprises a drive unit 40 that incorporates the propulsion device 36, the engine 38 and a bracket assembly 42. The bracket assembly 42 supports the drive unit 40 on a transom of the hull 34 so as to place the propulsion device 36 in a submerged position with the watercraft 32 resting on the surface of a body of water. The bracket assembly 42 preferably comprises a swivel bracket and a clamping bracket. The drive unit 40 is steerable and tiltable by the combination of the swivel and the clamping brackets.

As used through this description, the terms "forward," "forwardly" and "front" mean at or to the side where the bracket assembly 42 is located, and the terms "rear," "reverse," "backwards" and "rearwardly" mean at or to the opposite side of the front side, unless indicated otherwise or otherwise readily apparent from the context use.

The engine 38 is disposed atop the drive unit 40. The engine 38 preferably comprises a crankshaft or output shaft extending vertically. A driveshaft 46 coupled with the crankshaft extends vertically through a housing of the drive unit 40 disposed below the engine 38. The housing of the drive unit 40 journals the driveshaft 46 for rotation. The crankshaft drives the driveshaft. The drive unit 40 also journals a propulsion shaft 48 for rotation. The propulsion shaft 48 extends generally horizontally through a lower portion of the housing. The driveshaft 46 and the propulsion shaft 48 are preferably oriented normal to each other (e.g., the rotation axis of propulsion shaft 48 is at 90° to the rotation axis of the driveshaft 46).

As used in this description, the term "horizontally" means that the subject portions, members or components extend generally in parallel to the water line when the watercraft 32 is substantially stationary with respect to the water line and when the drive unit 40 is not tilted and is generally placed in the position shown in FIG. 1. The term "vertically" in turn means that portions, members or components extend generally normal to those that extend horizontally.

The propulsion shaft 48 drives the propulsion device 36 through a transmission 50. In the illustrated arrangement, the propulsion device 36 is a propeller that is affixed to an outer end of the propulsion shaft 48. The propulsion device 36, however, can take the form of a dual, a counter-rotating system, a hydrodynamic jet, or any of a number of other suitable propulsion devices. A shift mechanism 52 (FIG. 3) associated with the transmission 50 changes the position of the transmission 50. The transmission 50 and the shift mechanism 52 will be described in greater detail below.

A protective cowling preferably surrounds the engine 38. The protective cowling comprises a bottom cowling member 54 (FIG. 3) and a top cowling member. The bottom cowling member 54 is affixed to a top portion of the housing. The bottom cowling member 54 has an opening 56 through which an upper portion of the housing or an exhaust guide member extends. The bottom cowling member 54 and the upper portion of the housing together form a tray. The engine 38 is placed onto this tray and is affixed to the upper portion of the housing.

The top cowling member preferably is detachably affixed to the bottom cowling member 66 by a coupling mechanism so that a user, operator, mechanic or repairperson can access the engine 32 for maintenance or for other purposes. The top cowling member preferably has an air intake opening through which ambient air is drawn into a closed cavity around the engine 38.

Any type of conventional engines can be the engine 38 in the illustrated arrangement. Preferably the engine is an internal combustion engine. For this preferred type of engine, an air intake device draws the air in and delivers the drawn air to one or more combustion chambers of the engine 38. The intake device preferably has one or more throttle valves to regulate an amount of the air or airflow to the combustion chambers. A charge former such as, for example, a fuel injection system preferably supplies fuel also to the combustion chambers to form air/fuel charges in the one or more combustion chambers. A control device such as, for example, an electronic control unit (ECU) 60 preferably controls an amount of the fuel such that an air/fuel ratio can be kept in the optimum state. A firing device having ignition elements (e.g., spark plugs) exposed into the combustion chambers preferably ignites the air/fuel charges in the combustion chambers under control of the ECU 60. Abrupt expansion of the volume of the air/fuel charges, which bum in the combustion chambers, moves pistons connected to the crankshaft to rotate the crankshaft. The crankshaft thus drives the driveshaft 46. An exhaust device routes exhaust gases in the combustion chambers to an external location of the outboard motor 30. Unless the environmental circumstances change, an engine speed of the engine 38 increases generally along with an increase of the amount of the air or airflow rate.

The transmission 50 preferably comprises a drive pinion, a forward bevel gear and a reverse bevel gear to couple the two shafts 46, 48. The drive pinion is disposed at the bottom of the driveshaft 46. The forward and reverse bevel gears are disposed on the propulsion shaft 48 and are spaced apart from each other. Both bevel gears always mesh with the drive pinion. The bevel gears, however, race on the propulsion shaft 48 unless fixedly coupled with the propulsion shaft 48.

FIG. 3 shows a top part of the shift mechanism 52 that is disposed above the bottom cowling member 54, and that is configured generally in accordance with a conventional shift mechanism. An example of a shift mechanism is disclosed in U.S. Pat. No. 5,910,191, which is hereby incorporated by reference. A large part of the shift mechanism 52 extends below the bottom cowling member 54. The large part of the shift mechanism 52 preferably includes a dog clutch. The dog clutch is slideably but not rotatably disposed between the forward and reverse bevel gears on the propulsion shaft 48 so as to selectively engage the forward bevel gear or the reverse bevel gear or not engage any one of the forward and reverse bevel gears. The forward bevel gear or the reverse bevel gear can be fixedly coupled with the propulsion shaft 48 when the dog clutch unit engages the forward bevel gear or the reverse bevel gear, respectively.

The shift mechanism 52 preferably includes a shift rod 64 that extends vertically through the housing of the drive unit 40. A top end of the shift rod 64 extends upwardly beyond the bottom cowling member 54 through the opening 56. The shift rod 64 can rotate about an axis thereof The shift rod 64 preferably has a shift cam at the bottom. The shift cam that cooperates with a front section of the dog clutch unit, and more preferably with an end of a shift plunger of the dog clutch unit. The dog clutch unit thus follows the rotational movement of the cam and slides along the propulsion shaft 48 to engage either the forward or reverse bevel gear or to not engage any one of the bevel gears when in a neutral position.

Engagement states of the forward and reverse bevel gear with the dog clutch unit correspond to operational modes of the propeller. Preferably, the operational or shift modes of the propeller include a forward mode F, a reverse mode R and a neutral mode N. A first position of the transmission 50 at which the dog clutch unit engages the forward bevel gear sets the propeller to the forward mode F. A second position of the transmission 50 at which the dog clutch unit engages the reverse bevel gear sets the propeller to the reverse mode R. A third position of the transmission 50 at which the dog clutch unit does not engage the forward bevel gear or the reverse bevel gear sets the propeller to the neutral mode N. In the forward mode F, the propeller rotates, for example, in a right rotational direction that propels the watercraft 32 forwardly. In the reverse mode R, the propeller rotates, for example, in a reverse rotational direction that propels the watercraft 32 backwards. In the neutral mode N, the propeller does not rotate and does not propel the watercraft 32.

With reference to FIG. 3, a lever unit 66 is rigidly affixed to the top end of the shift rod 64. In this arrangement, a single lever forms the lever unit 66. The lever unit 66, in turn, forms a shift unit in one aspect of the present invention. Because the shift rod 64 extends generally along a center plane CP that extends vertically fore to aft in the center of the outboard motor 30, the lever unit 66 is placed generally at a center position of the bottom cowling member 54.

Figure 6:
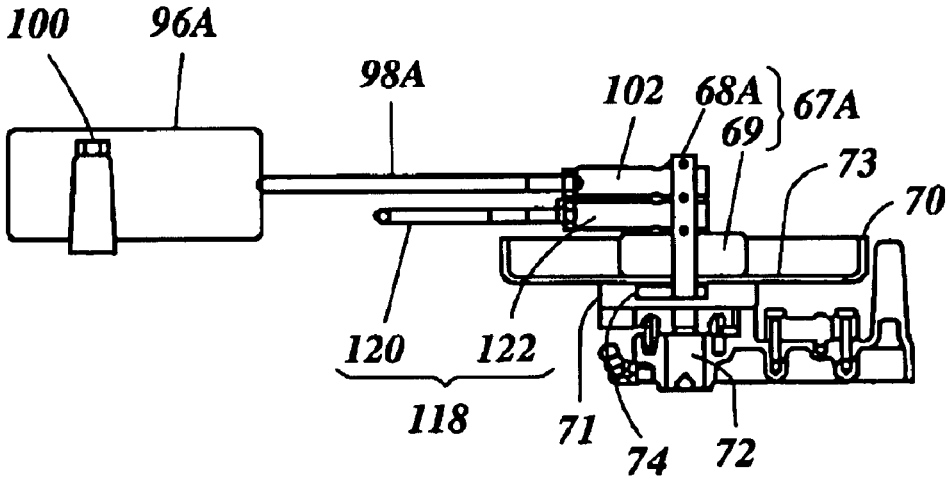
FIG. 6 illustrates a side elevational view of the arrangement of FIG. 5 as isolated from the outboard motor.

A slide unit 67 preferably is slideably disposed within a guide member 70. The slide unit 67 forms another shift unit in one aspect of the present invention. The illustrated slide unit 67 comprises a slide pin 68 and a slide block 69 that supports the slide pin 68. The guide member 70 preferably is located on a starboard side of the bottom cowling member 54 and is affixed to a base member 71 (FIG. 6). Preferably, the base member 71 is affixed onto the bottom cowling member 54 and can pivot about an axis of a pivot shaft 72. The guide member 70 preferably has an elliptic shape that forms an elongate slot 73 therein. A front portion of the guide member 70 is slightly slanted toward the center plane CP. The slide unit 67 is movable within the slot 73.

A connecting member 74 extends generally along a front edge of the opening 56 on the starboard side and connects the lever unit 66 and the slide unit 67. One end of the connecting member 74 is pivotally coupled with the lever unit 66. Another end of the connecting member 74 is rigidly coupled with a bottom of the slide unit 67. In the illustrated embodiment, the lever unit 66, the connecting member 74, the slide unit 67 and the guide member 70 together form the top part of the shift mechanism 52.

The bottom cowling member 54 preferably has a cable support 78 at a front end thereof on the starboard side. The cable support 78 defines an opening extending fore to aft. A mechanical cable or push-pull cable 80 extends through the opening and to the slide unit 67. The mechanical cable 80 comprises an outer shell and an inner wire. The outer shell is affixed to an inside wall of the opening, while the inner wire is affixed to the slide unit 67 via a joint portion 82 thereof. A clip 84 prevents the joint portion 82 from disengaging from the slide pin 68. The joint portion 82 is pivotally coupled with the slide pin 68. The inner wire has flexibility. The opening preferably is located right in front of the slide pin 68 when the slide pin 68 is positioned at the center of the slot 73 of the guide member 70. The slide unit 67 thus can slide back and forth within the slot 73 in response to a reciprocal movement of the inner wire.

The positioning of the slide unit 67 at the center of the slot 73 corresponds to the neutral position of the transmission that sets the propeller to the neutral mode N. As thus constructed, when the mechanical cable 80 is operated to move the slide unit 67 back and forth, the lever unit 66 pivots about an axis of the shift rod 64 via the connecting member 74 to rotate the shift rod 64. Preferably, shift rod 64 shifts the transmission 50 to the forward position while the slide unit 67 moves toward a front end of the slot 73, and shifts the transmission 50 to the reverse position while the slide unit 67 moves toward a rear end of the slot 73. More specifically, the dog clutch engages the forward bevel gear while the slide unit 67 moves toward the front end of the slot 73. Also, the dog clutch engages the reverse bevel gear while the slide unit 67 moves toward the rear end of the slot 73.

In this description, the position of the slide unit 67 corresponding to the neutral mode N of the propeller is a neutral shift position of the slide unit 67, the position of the slide unit 67 corresponding to the forward mode F of the propeller is a forward shift position of the slide unit 67, and the position of the slide unit 67 corresponding to the reverse mode R of the propeller is a reverse shift position of the slide unit 67. Preferably, a length of the longitudinal axis of the slot 73 along which the slide unit 67 slides is longer than a distance between the forward shift position and the reverse shift position. In other words, the slide unit 67 does not fully move between front and rear ends of the slot 73 so as to ensure sound engagement of the dog clutch with the forward or reverse bevel gear.

With reference to FIG. 1, the watercraft 32 has a mechanical remote controller 86 that comprises a mechanical junction box 88 and a remote control lever 90. The remote controller 86 is disposed in a cockpit 92 of the watercraft 32. The mechanical cable 80 extends to the control lever 90 through the mechanical junction box 88 from the outboard motor 30. The control lever 90 is pivotally affixed to the junction box 88 and pivots back and forth when an operator operates the control lever 90. Preferably, when the control lever 90 pivots forward, the slide unit 67 slides forward within the slot 73, and when the control lever 90 pivots backward, the slide unit 67 slides backward within the slot 73.

Additionally, the control lever 90 also can be connected to a linkage of the throttle valves of the engine 38 through another mechanical cable to control the position of the throttle valves also in response to the movement of the control lever 90.

Generally, a watercraft is assembled in a factory with an outboard motor and carries such a mechanical shift control system described above. A customer or user of the watercraft may want to customize the watercraft and the outboard motor to incorporate an electrical shift control system instead of the mechanical shift control system.

Figure 4:
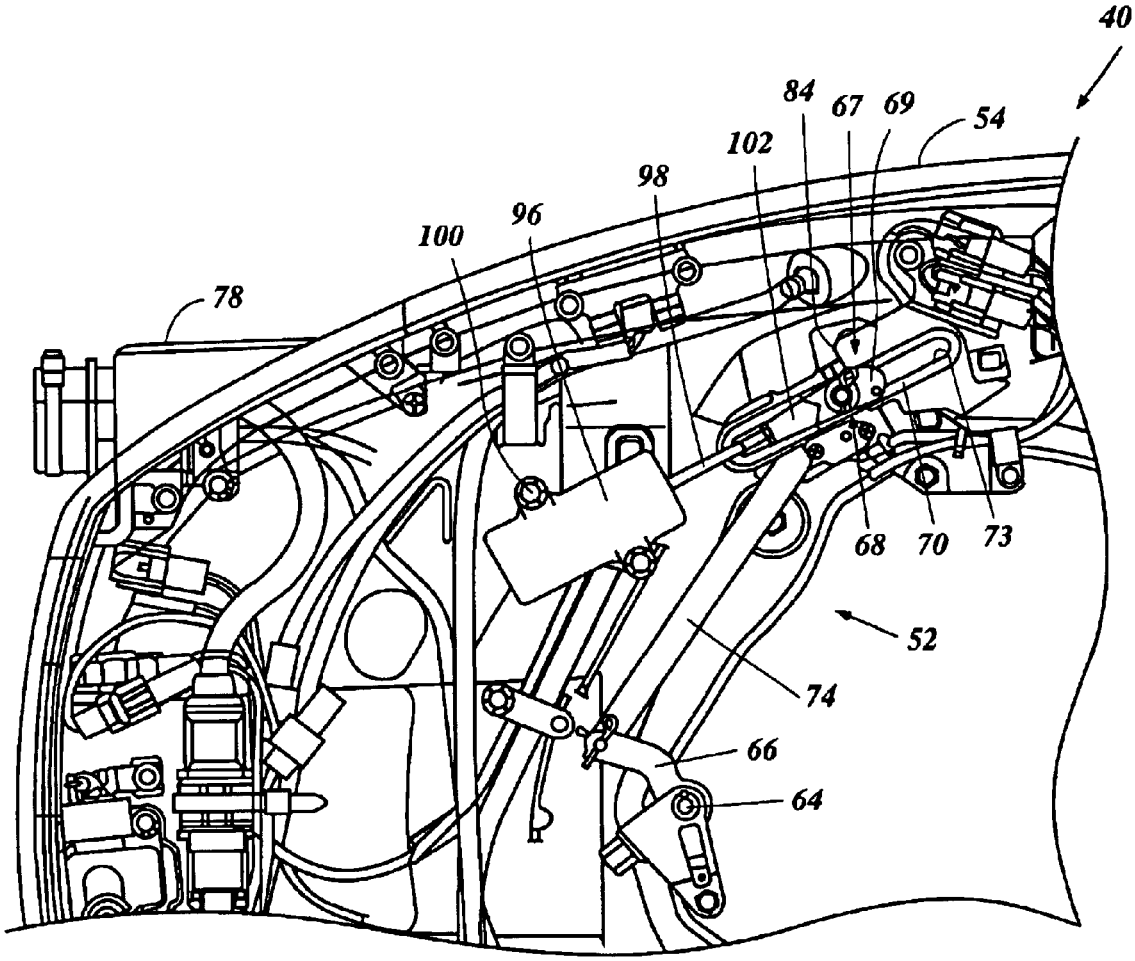
FIG. 4 illustrates an enlarged top plan view of the outboard motor without the top cowling member, wherein in this preferred embodiment the outboard motor has a shift actuator, which includes an electromagnetic solenoid, coupled with the shift unit.

With reference to FIGS. 1, 2 and 4, a first embodiment of the electrical shift control system configured in accordance with certain features, aspects and advantages of the present invention is described below. The same members, components and devices already described above are assigned with the same reference numerals as those assigned thereto and are not described repeatedly.

With reference to FIG. 4, in the first preferred embodiment, the electrical shift control system preferably employs a shift actuator 96 that replaces the mechanical cable 80. The illustrated shift actuator 96 lies generally horizontally in front of the guide member 70 and adjacent to the guide member 70. The shift actuator 96 preferably comprises a housing, an electromagnetic solenoid enclosed within the housing and an actuating member 98 extending generally horizontally toward the slide unit 67 from the solenoid. The actuating member 98 in this embodiment is a rod. The solenoid embraces the actuating member 98 in the housing such that the actuating member 98 linearly and reciprocally extends and retracts relative to the housing along an axis of the actuating member 98. Other types of drive mechanisms, such as, for example, stepper- or servo-motors can be used in place of the solenoid in this application.

Preferably, the shift actuator 96 is positioned to place the axis of the actuating member 98 to coincide with an axis of the slot 73 of the guide member 70. The shift actuator 96 is affixed onto the top surface of the bottom cowling member 54 by bolts 100 to keep the relationship between the actuating member 98 and the guide member 70. Preferably, a joint portion 102, which is made unitarily or separately with the actuating member 98, pivotally couples the actuating member 98 with the slide pin 68 of the slide unit 67. The slide unit 67 thus slides within the slot 73 when the actuating member 98 reciprocally moves.

The ECU 60 (FIG. 1) preferably controls the solenoid of the actuator 96. In one variation, another control device such as, for example, a specially designed control device for the shift actuator 96 can control the actuator 96. An electric source such as, for example, one or more batteries can supply electric power to the solenoid under control of the ECU 60. The solenoid is energized or de-energized by the electric power to move the actuating member 98 among the three positions corresponding to the forward, neutral and reverse positions of the transmission 50.

Because the axes of the actuating member 98 and the slot 73 are consistent with each other in this embodiment, the actuating member 98 can push and pull the slide unit 67 so smoothly that minimal friction is generated between the slide unit 67 and the guide member 70. The actuating load of the shift actuator 96 thus is greatly reduced.

A throttle valve actuator also is provided in this embodiment to electrically actuate the throttle valves under control of the ECU 60.

With reference to FIGS. 1 and 2, an electrical remote controller 106 preferably is disposed in the cockpit 92 alternatively or additionally to the mechanical remote controller 86. If the user prefers the electric shift control system, the mechanical remote controller 86 is not set in the cockpit 92 and the mechanical cable 80 is also removed. Wire-harness 108 connects the remote controller 106 to the ECU 60. A network such as, for example, local area network (LAN) or other electrically connecting members can replace the wire-harness 108.

With reference to FIG. 2, the remote controller 106 preferably has a remote control lever 110 that is journaled on a housing of the remote controller 106 for pivotal movement. The control lever 110 is operable by the operator so as to pivot between two limit ends F2 and R2. A forward acceleration range, a forward troll position F1, a neutral control position N0, a reverse troll position R1 and a reverse acceleration range can be selected in this order between the limit ends F2 and R2. The forward acceleration range is a range extending between the limit end F2 and the forward troll position F1. The forward limit end F2 is a maximum acceleration position of the forward acceleration range. Similarly, the reverse acceleration range is a range extending between the reverse troll position R1 and the other limit end R2. The reverse limit end R2 is a maximum acceleration position of the reverse acceleration range. The forward troll position F1 is consistent with a minimum acceleration position of the forward acceleration range, while the reverse troll position R1 is consistent with a minimum acceleration position of the reverse acceleration range. Preferably, the control lever 110 stays at any position between the limit ends R2 and F2 unless the operator moves the lever 110.

The remote controller 106 in the illustrated embodiment provides the ECU 60 with a shift position command corresponding to the control positions between the forward limit end F2 and the reverse limit end R2. The remote controller 106 preferably has a shift position sensor 114 that senses the position of the control lever 110 and sends a shift position command signal to the ECU 60. The ECU 60 thus controls the shift actuator 96 based upon the shift position command signal.

A range of the movement of the control lever 110 between the forward troll position F1 and R1 preferably corresponds to a range of the movement of the slide unit 67. When the control lever 110 moves from the neutral control position N0 to the forward troll position F1, the actuator 96 moves the slide unit 67 from the neutral shift position to the forward shift position that exists on the way toward the front end of the slot 73. The dog clutch engages the forward bevel gear when the control lever 110 reaches the forward troll position F1 and the slide unit 67 reaches the forward shift position. On the other hand, when the control lever 110 moves from the neutral control position N0 to the reverse troll position R1, the actuator 96 moves the slide unit 67 from the neutral shift position to the reverse shift position that exists on the way toward the rear end of the slot 73. The dog clutch engages the reverse bevel gear when the control lever 110 reaches the reverse troll position R1 and the slide unit 67 reaches the reverse shift position.

The remote controller 106 also provides the ECU 60 with a throttle valve position command in accordance with an angle position within the forward acceleration range between the forward troll position F1 and the forward limit end F2 or an angle position within the reverse acceleration range between the reverse troll position R1 and the reverse limit end R2.

Such an electrical shift control system is disclosed in, for example, a co-pending U.S. application filed Jul. 22, 2003, titled CONTROL CIRCUITS AND METHODS FOR INHIBITING ABRUPT ENGINE MODE TRANSITIONS IN A WATERCRAFT, which application Ser. No. is 10/624,204, the entire contents of which is hereby expressly incorporated by reference.

The remote controller 106 preferably incorporates a neutral switch to disable the engine 38 from being started while the propeller is either in the forward mode F or the reverse mode R. That is, the neutral switch can be turned on a closed when the control lever 110 is positioned at the neutral control position N0. A starter motor or other starting devices of the engine 38 is allowed to start the engine 38 only when the neutral switch is turned on.

Because the actuator 96 that has the actuating member 98 reciprocally movable in this embodiment, the electrical shift control system can be easily changed to the mechanical shift control system that has the mechanical cable reciprocally movable and vice versa.

With reference to FIGS. 5–8, a second preferred embodiment of the electrical shift control system, which is configured in accordance with certain features, aspects and advantages of the present invention, is described below. The same members, components and devices already described above are assigned with the same reference numerals as those assigned thereto and are not described again. Members, components and devices modified slightly (e.g., the length or shape) are indicated by the same numerals with an alphabetic suffix and are not described further as well. This convention of referencing such members, components and devices will be used throughout the following description.

Figure 5:
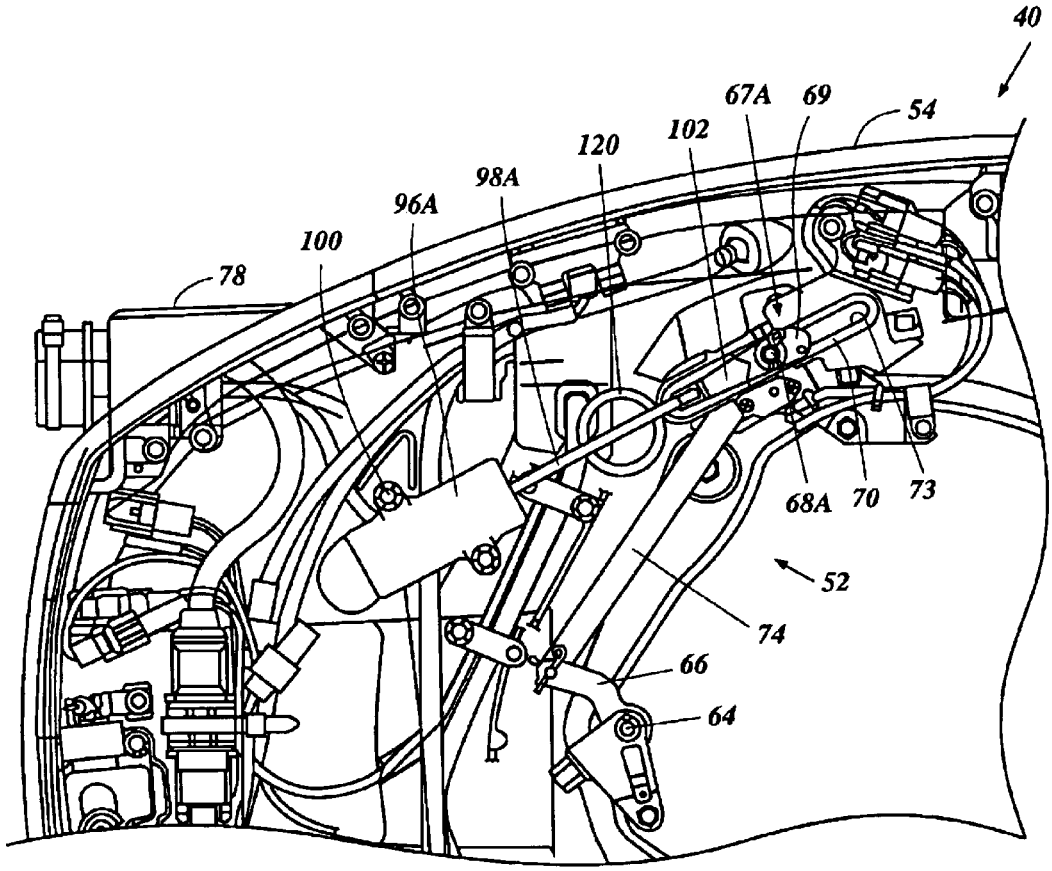
FIG. 5 illustrates an enlarged top plan view of the outboard motor without the top cowling member, wherein a shift actuator arranged in accordance with a second preferred embodiment of the present invention is shown with a manual operating member also is coupled with the shift unit.

With reference to FIGS. 5 and 6, a modified shift actuator 96A in this embodiment has an actuating member 98A that is longer than the actuating member 98 of the first embodiment. Also, a slide pin 68A is slightly longer than the slide pin 68 of the first embodiment. An operating member 118 is disposed under the actuating member 98A. The operating member 118 comprises a ring-shaped grip portion 120 and a joint portion 122. The joint portion 122 is pivotally coupled with the slide pin 68A of the slide unit 67A.

Figure 7:
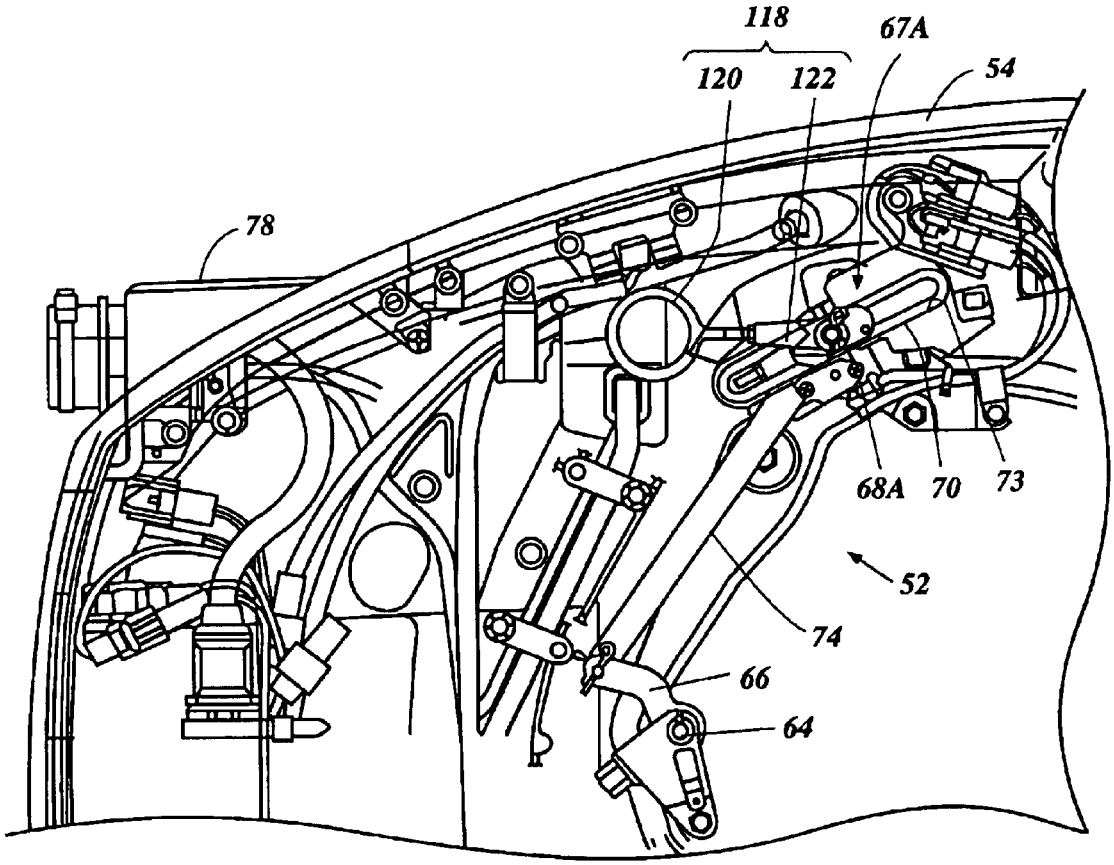
FIG. 7 illustrates a top plan view of the same arrangement as FIG. 5 as isolated from the outboard motor, wherein the shift actuator of FIGS. 5 and 6 is detached.
Figure 8:
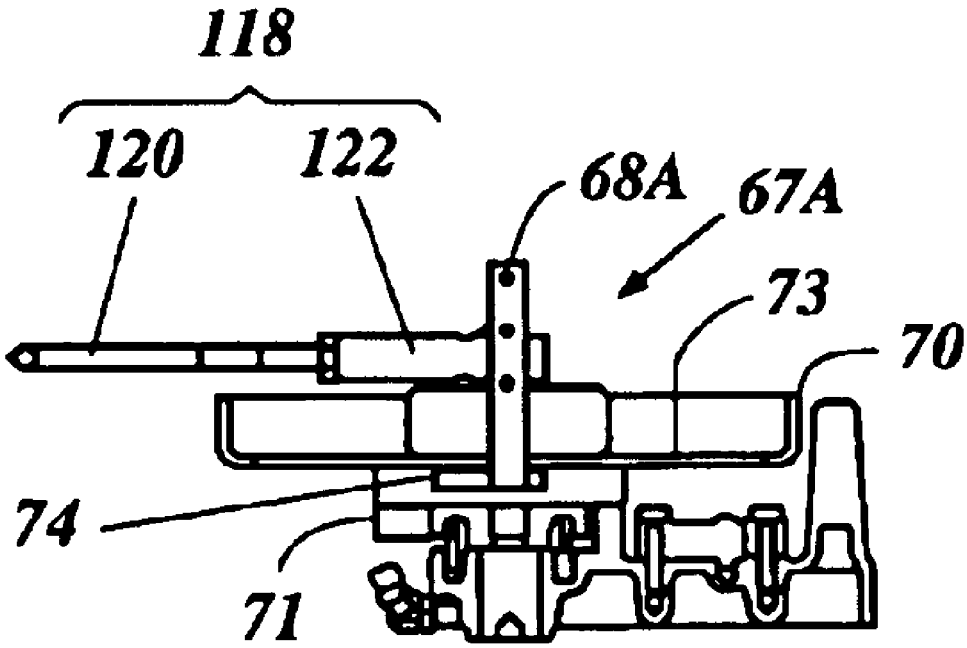
FIG. 8 illustrates a side elevational view of the arrangement of FIG. 7.

With reference to FIGS. 7 and 8, the shift actuator 96A can be detached from the top surface of the bottom cowling member 54 by removing the bolts 100 and detaching the joint portion 102 of the actuating member 98A from the slide pin 68A. The operating member 118 is exposed when the shift actuator 96A together with the actuating member 98A is detached. Because of this arrangement, the operator can manually operate the operating member 118 to move the shift mechanism 52 in the event of malfunction of the actuator 96A by detaching the shift actuator 96A.

The operator can relocate the operating member 118 relative to the slide pin 68A to an optimum position so as to easily operate the operating member 118. In order to operate the operating member 118, the operator preferably grasps the ring-shaped grip portion 120 with secure fingers. If the operating member 118 is relocated to a position at which the operating member 118 faces the opening of the cable support 78 as shown in FIG. 7, the operator can connect a rope or similar article to the ring shaped grip portion 120 and can pass the rope through the opening of the cable support 78 to position a distal end of the rope at an external location. With this arrangement, the operator can operate the operating member 118 even if the top cowling member is attached to the bottom cowling member 54.

With reference to FIGS. 9–12, a third preferred embodiment of the electrical shift control system, which is configured in accordance with certain features, aspects and advantages of the present invention, is described below.

Figure 9:
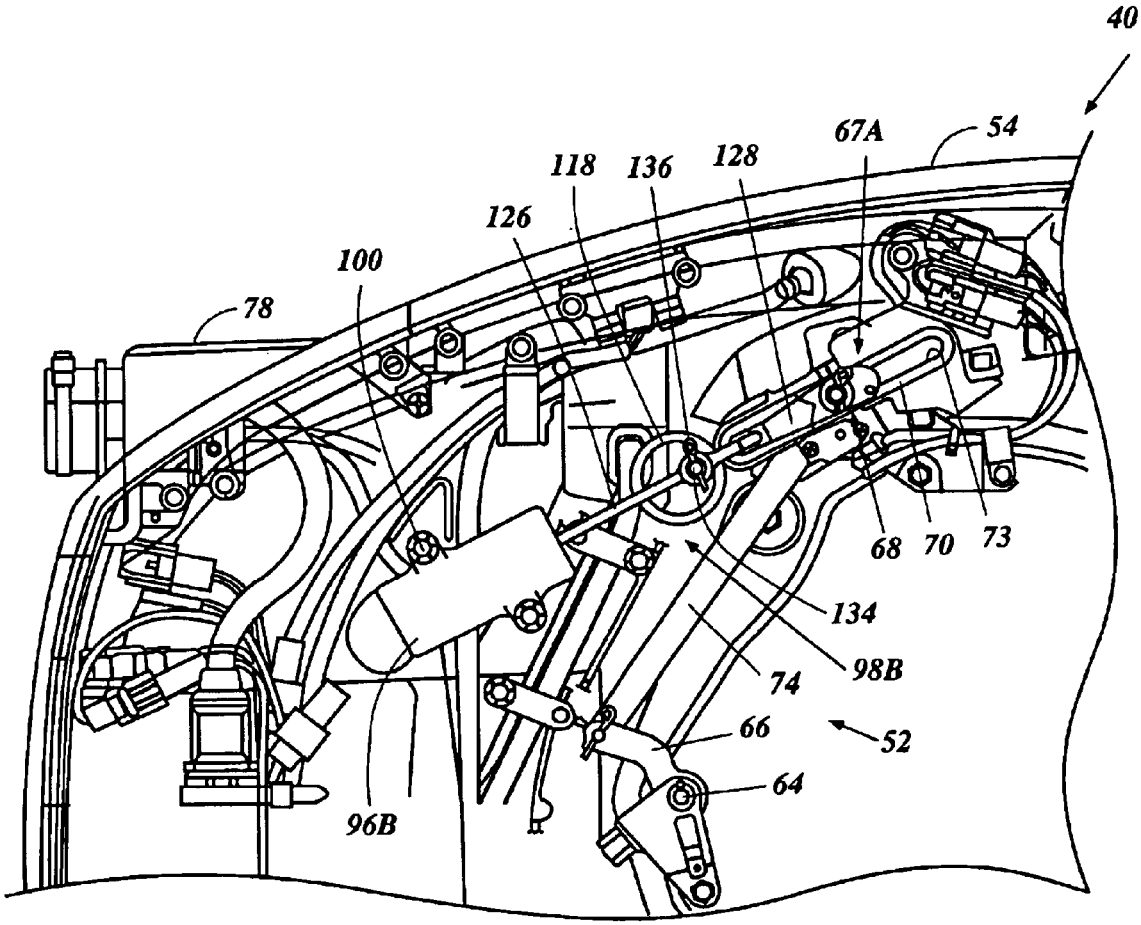
FIG. 9 illustrates an enlarged top plan view of the outboard motor without the top cowling member, wherein a shift actuator arranged in accordance with a third embodiment of the present invention is shown with the manual operating member of FIGS. 5–8 is coupled with the shift unit.
Figure 10:
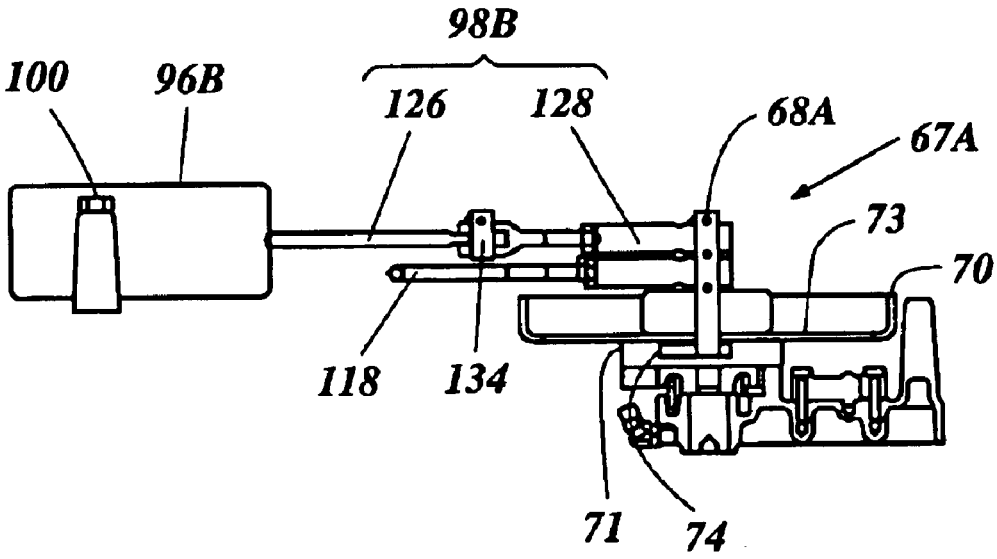
FIG. 10 illustrates a side elevational view of the arrangement of FIG. 9 as isolated from the outboard motor.

As seen in FIGS. 9 and 10, a modified shift actuator 96B preferably has an actuating member 98B that comprises a first section 126 and a second section 128. The first section 126 extends from the actuator 96B toward the slide unit 67A. The second section 128 has a joint portion that can be coupled with the slide pin 68A of the slide unit 67A. In the illustrated embodiment, the joint portion of the second section 128 is pivotally coupled with the slide pin 68A such that the second section 128 extends toward the first section 126.

Preferably, a distal end 130 (FIG. 11) of the first section 126 is shaped as a ring. A distal end 132 (FIGS. 11 and 12) of the second section 128 is bifurcated vertically and the bifurcated ends are spaced apart from each other. Each bifurcated end is shaped as a ring that has generally the same size as the ring of the first section 126. The ring-shaped distal end 130 of the first section 126 is placed between the distal end 132, i.e., between both of the bifurcated and ring-shaped ends, 132 of the second section 128. A connecting pin 134 is inserted into those ring-shaped distal ends 130, 132 to pivotally connect the first and the second sections 126, 128. A clip 136 preferably is affixed to a top end of the connecting pin 134 to prevent the pin 134 from slipping off. The operating member 118 also is positioned under the actuating member 98B in this embodiment.

Figure 11:
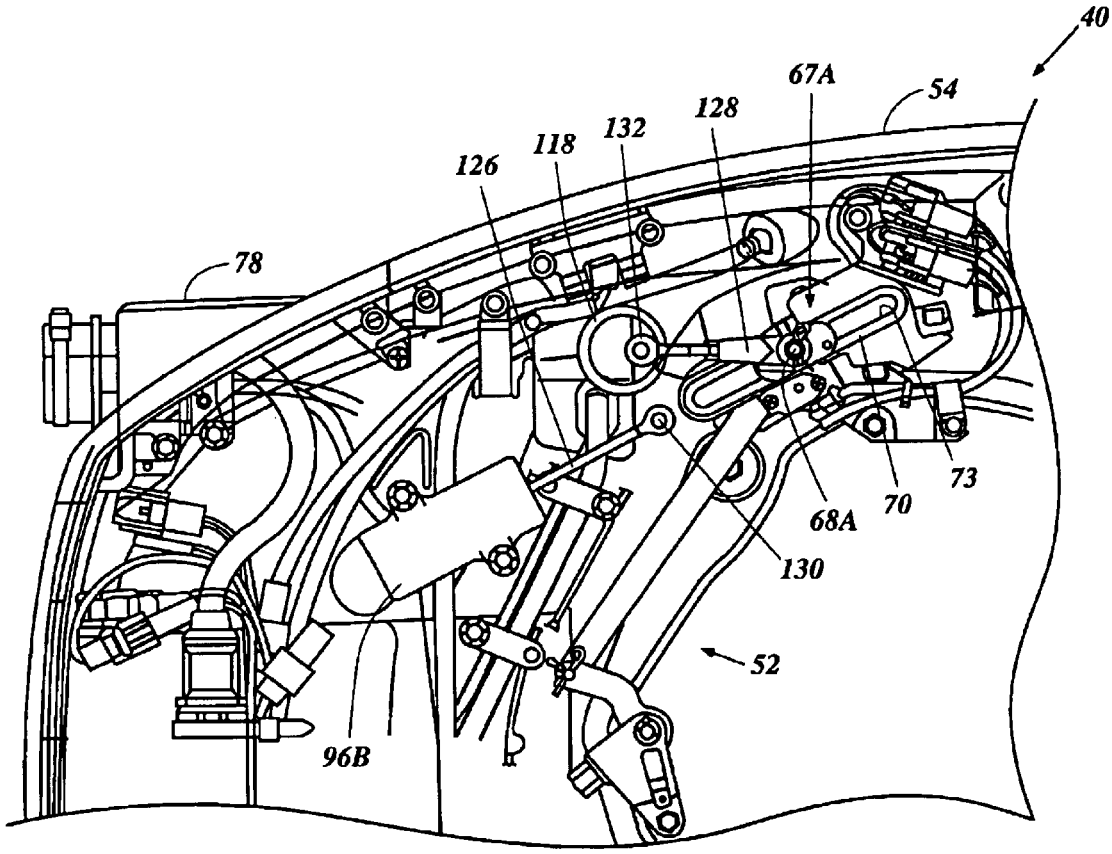
FIG. 11 illustrates a top plan view of the arrangement of FIG. 9 as isolated from the outboard motor, wherein two sections of an actuating member of the shift actuator of FIG. 9 are disconnected.
Figure 12:
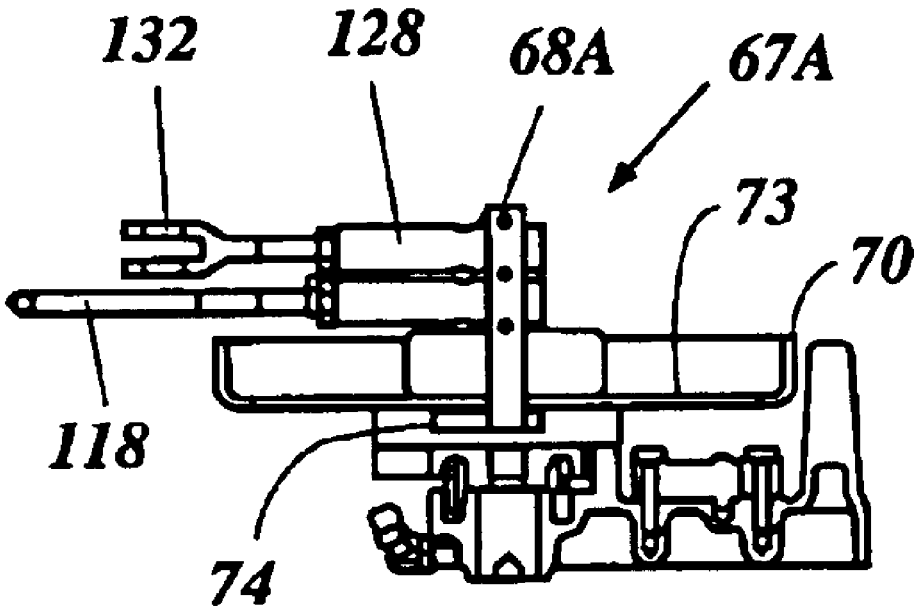
FIG. 12 illustrates a side elevational view of the arrangement of 11, wherein the shift actuator and one section of the actuating member extending from a housing of the actuator are not shown.

With reference to FIGS. 11 and 12, the operator can manually operate the shift mechanism 52 in a manner similar to the second embodiment. In order to manually operate the shift mechanism, the first and second sections 126, 128 are separated from each other. The clip 136 is removed and then the connecting pin 134 is extracted from the ring-shaped ends of the first and second section 126, 128. The second section 128 remains on the slide unit 67A. The operator can relocate the operating member 118 together with the second section 128 relative to the slide pin 68A to an optimum position so as to easily operate the operating member 118. Alternatively, the second section 128 can solely remain at the initial position (i.e., the second section 128 does not move together with the operating member 118).

With reference to FIGS. 13–17, a fourth preferred embodiment of the electrical shift control system, which is configured in accordance with certain features, aspects and advantages of the present invention, is described below.

Figure 13:
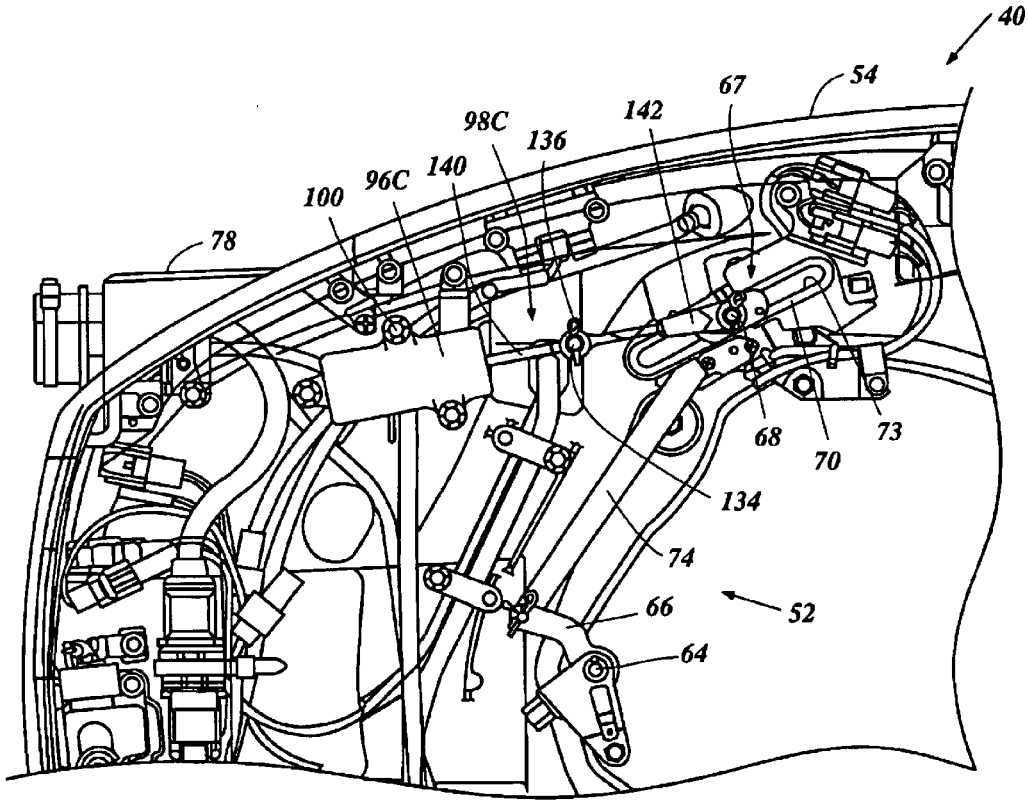
FIG. 13 illustrates an enlarged top plan view of the outboard motor without the top cowling member, wherein a shift actuator is arranged in accordance with a fourth embodiment of the present invention and two sections of the actuating member are pivotally connected with each other.
Figure 14:
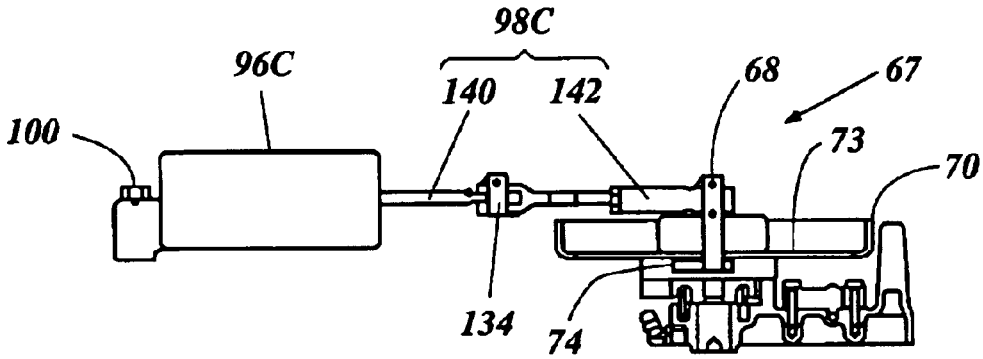
FIG. 14 illustrates a side elevational view of the arrangement of FIG. 13 as isolated from the outboard motor.

As seen in FIGS. 13 and 14, a further modified shift actuator 96C preferably has an actuating member 98C. In this embodiment, the shift actuator 96C is located slightly closer to a side surface of the bottom cowling member 54 on the starboard side. Thus, an axis of the actuating member 98C is skewed relative to the axis of the slot 73 of the guide member 70. The actuating member 98C comprises a first section 140 and a second section 142. The first section 140 extends from the actuator 96C toward the slide unit 67. The second section 142 has a joint portion that can be coupled with the slide pin 68 of the slide unit 67. In the illustrated embodiment, the joint portion of the second section 142 is pivotally coupled with the slide pin 68 such that the second section 142 extends toward the first section 140.

Similarly to the third embodiment, a distal end 130 of the first section 140 is shaped as a ring, while a distal end 132 of the second section 142 is bifurcated and each bifurcated end is shaped as a ring. The ring-shaped distal end 130 of the first section 140 is placed between the bifurcated ring-shaped ends 132 of the second section 142. The connecting pin 134 connects the first and the second sections 140, 142. The clip 136 preferably prevents the pin 134 from slipping off.

In this fourth embodiment, due to the axes being skewed relative to each other, the actuating member 98C does not move along the axis of the slot 73. However, the actuating member 98C can achieve relatively smooth movement of the slide unit 67 because the first and second sections 140, 142 are coupled pivotally about the vertical axis of the connecting pin 134.

Figure 15:
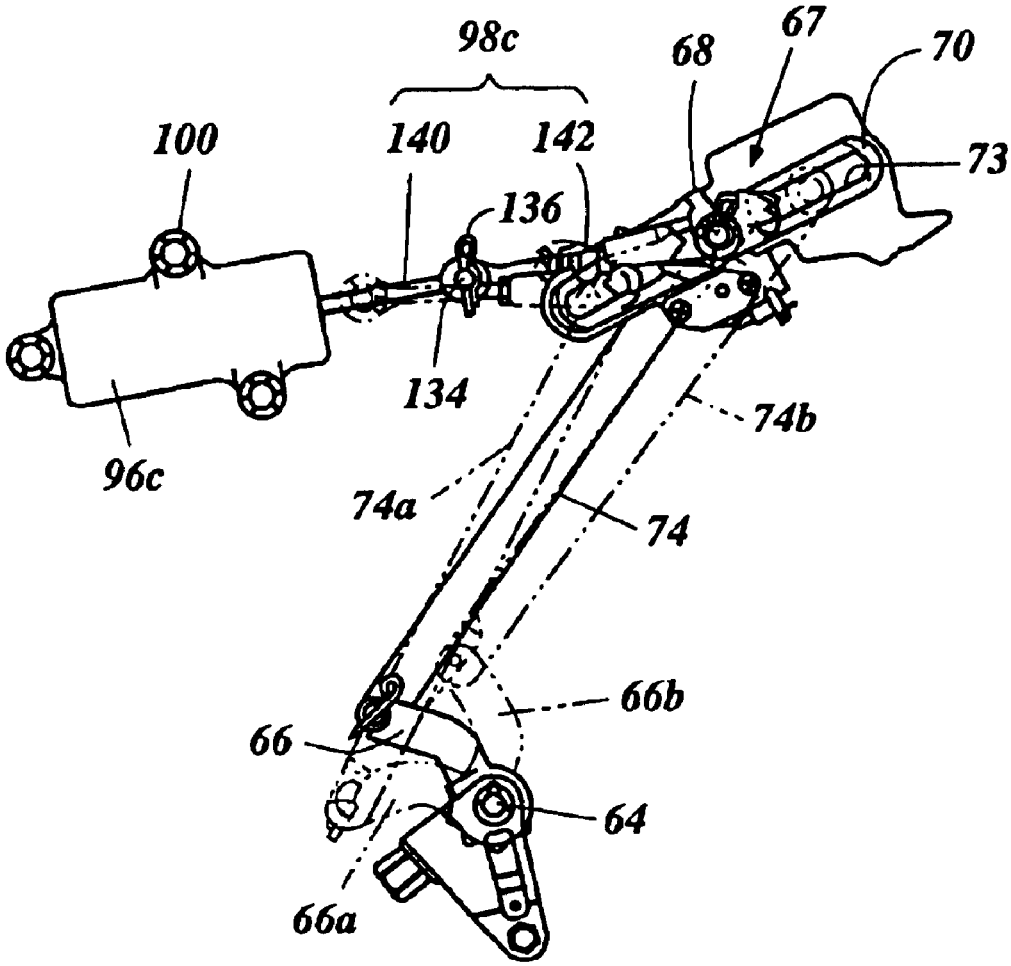
FIG. 15 illustrates a top plan view of the arrangement of FIG. 13, wherein a neutral position of the two sections of the actuating member with a connecting member and a lever unit of the shift mechanism is shown in solid lines and the position of these components wherein the forward and reverse positions are shown in phantom lines.

With reference to FIG. 15, the first and second sections 140, 142 of the actuating member 98C extend straight relative to each other when the shift actuator 96C is controlled by the ECU 60 to set the slide unit 67 at the neutral shift position. The slide unit 67 is positioned generally at the center of the slot 73 under this condition as indicated by the solid lines in the figure.

If the actuator 96C is controlled to place the slide unit 67 to the forward shift position, the actuating member 98C is retracted toward the housing of the actuator 96C. The slide unit 67 moves forward toward the front end of the slot 73 and the second section 142 slightly pivots toward the center plane CP about the axis of the connecting pin 134. The connecting member 74 thus moves as indicated by the phantom line 74*a* in the figure. The lever unit 66 pivots counter-clockwise as indicated by the phantom line 66*a* to rotate the shift rod 64 also counter-clockwise.

On the other hand, if the actuator 96C is controlled to place the slide unit 67 to the reverse shift position, the actuating member 98C extends outward from the housing of the actuator 96C. The slide unit 67 moves rearward toward the rear end of the slot 73 and the second section 142 slightly pivots in an opposite direction relative to the center plane CP about the axis of the connecting pin 134 as the slide unit 67 moves farther from the center plane CP. The connecting member 74 thus moves as indicated by the phantom line 74*b* in the figure. The lever unit 66 pivots clockwise as indicated by the phantom line 66*b* to rotate the shift rod 64 also clockwise.

Because of the pivotal movement of the second section 142 relative to the first section 140, the slide unit 67 can move smoothly with relatively little resisting force that can inhibit the slide unit 67 from sliding.

Figure 16:
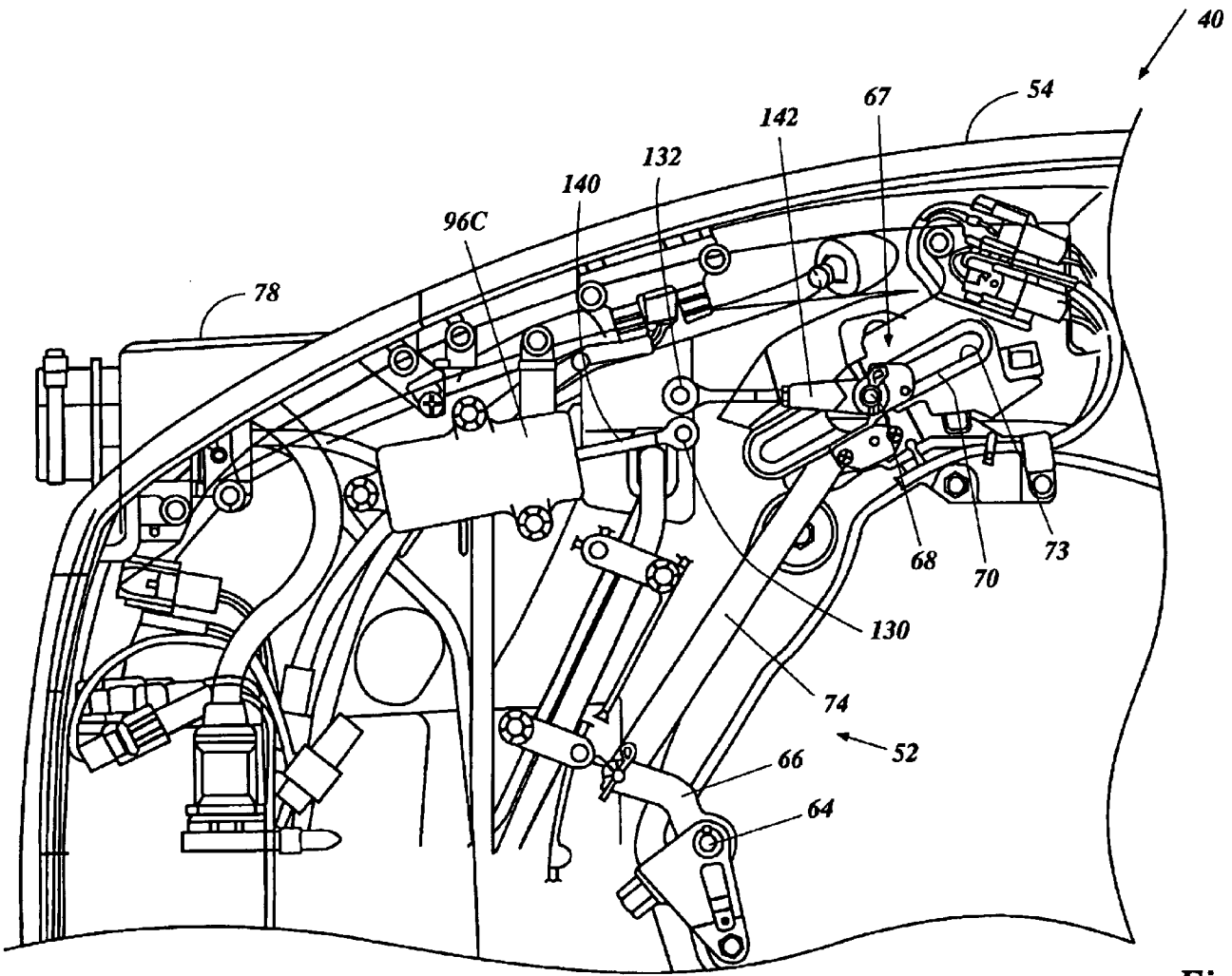
FIG. 16 illustrates a top plan view of the same arrangement as FIG. 13 except for that the two sections of the actuating member are disconnected.
Figure 17:
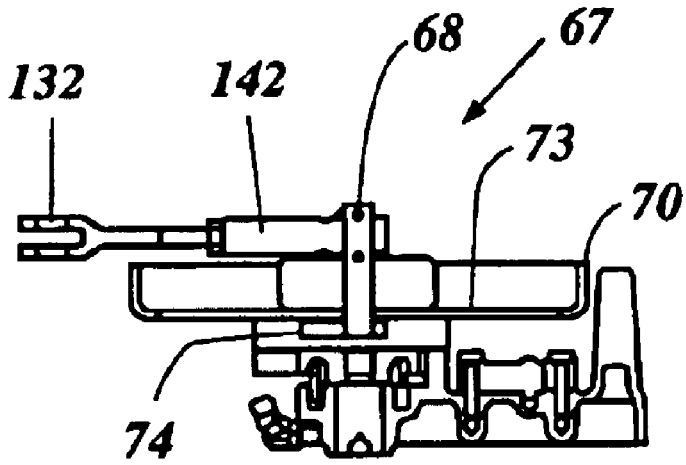
FIG. 17 illustrates a side elevational view of the arrangement of FIG. 13, wherein the shift actuator and one section of the actuating member extending from the housing of the actuator are not shown.

With reference to FIGS. 16 and 17, the operator can manually operate the shift mechanism 52 in this embodiment, similar to the second and third embodiments. In order to manually operate the shift mechanism 52, the first and second sections 140, 142 are separated from each other. The clip 136 is removed and then the connecting pin 134 is extracted from the ring-shaped ends of the first and second section 140, 142. The second section 142 remains on the slide unit 67.

Figure 18:
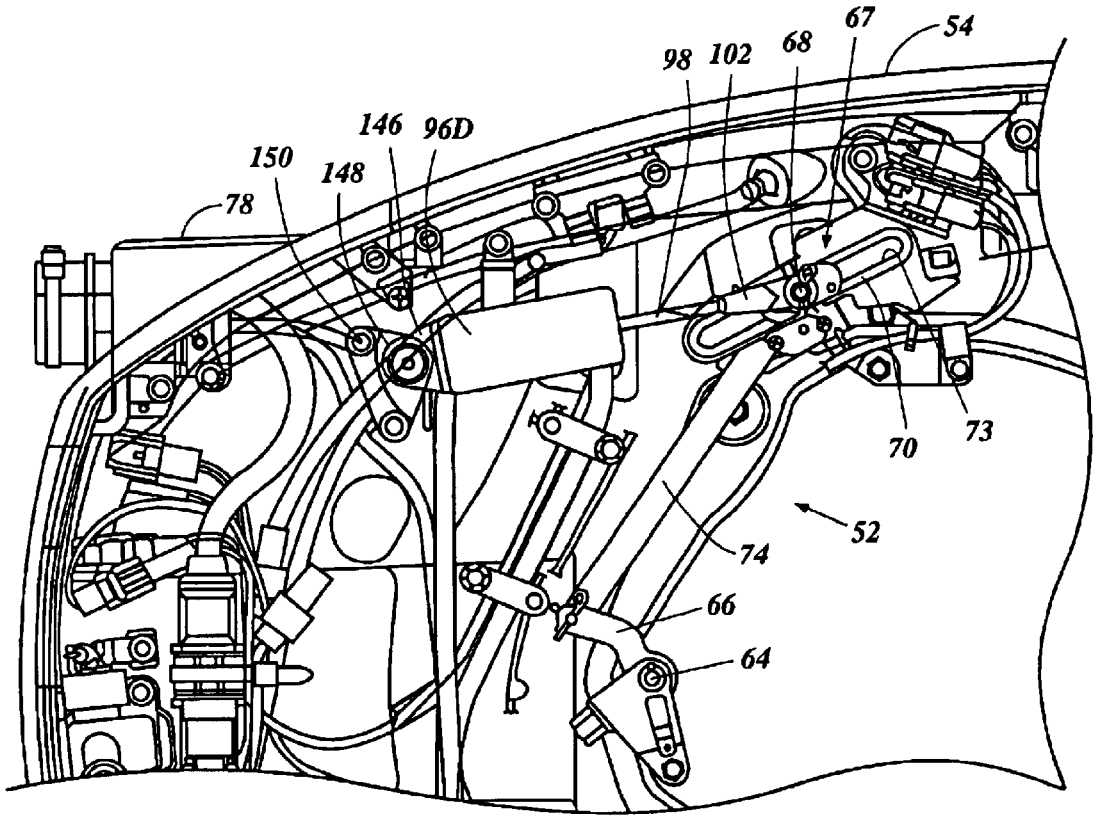
FIG. 18 illustrates an enlarged top plan view of the outboard motor without the top cowling member, wherein a shift actuator is arranged in accordance with a fifth embodiment of the present invention with the housing of the actuator pivotally affixed to a bottom cowling member of the outboard motor.
Figure 19:
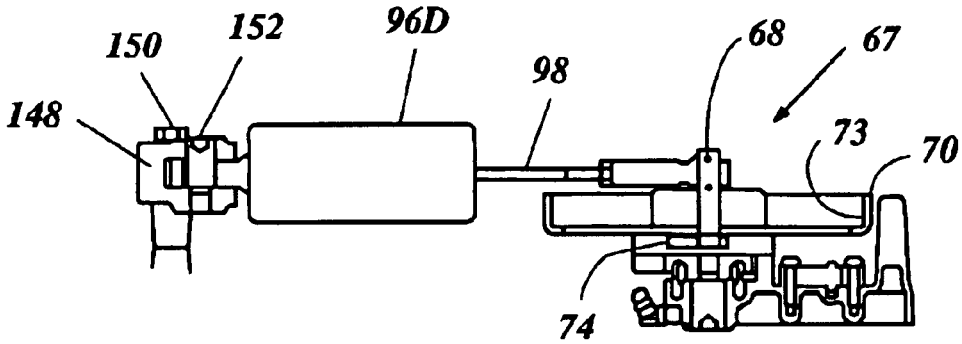
FIG. 19 illustrates a side elevational view of the arrangement of FIG. 18 as isolated from the balance of the outboard motor.
Figure 20:
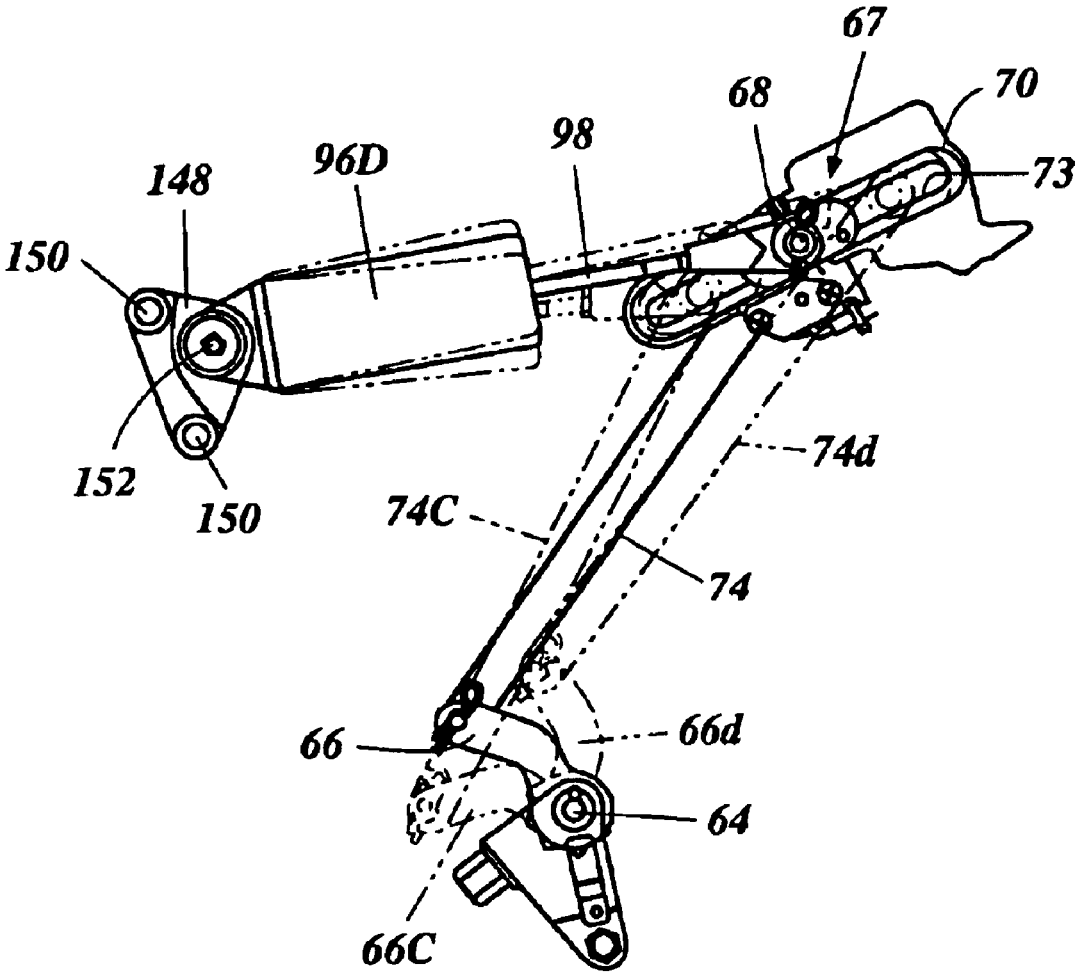
FIG. 20 illustrates a top plan view of the arrangement of FIG. 19, wherein three positions of the actuator with the actuating member, the connecting member and the lever unit are shown in actual and phantom lines.

With reference to FIGS. 18–20, a fifth preferred embodiment of the electrical shift control system, which is configured in accordance with certain features, aspects and advantages of the present invention, is described below.

As seen in FIGS. 18 and 19, a further modified shift actuator 96D in this embodiment is located slightly closer to the side surface of the bottom cowling member 54 on the starboard side, like the actuator 96C of the third embodiment. The actuator 96D has an actuating member 98 that has a joint portion 102 directly and pivotally coupled with the slide pin 68 of the slide unit 67. An axis of the actuating member 98 is skewed relative to the axis of the slot 73 of the guide member 70 because of the foregoing arrangement of the actuator 96D. The illustrated shift actuator 96D thus is affixed onto the bottom cowling member 54 to allow the housing of the actuator 96D to pivot relative to the bottom cowling member 54.

In the illustrated embodiment, the housing of the actuator 96D has a projection 146 that extends opposite to the actuating member 98 relative to the actuator 96D. A support member 148 preferably is rigidly affixed onto the bottom cowling member 54 by a pair of bolts 150. The support member 148 has a recess that creates a space between top and bottom surfaces of a center portion of the support member 148. The projection 146 is placed in the recess. The support member 148 and the projection 146 both have openings that align with each other. A connecting pin 152, which forms a support unit together with the support member, is inserted into the openings to pivotally couple the projection 146 with the support member 148. Thus, the housing of the actuator 96D is pivotal about a vertical axis of the connecting pin 152.

In this fifth embodiment, due to the axes being skewed relative to each other, the actuating member 98 does not move along the axis of the slot 73. However, the actuating member 98 can smoothly actuate the slide unit 67 because the housing of the actuator 96D is pivotally affixed to the bottom cowling member 54.

With reference to FIG. 20, the slide unit 67 is positioned as indicated by the solid lines in the figure when the shift actuator 96D is controlled by the ECU 60 to set the slide unit 67 at the neutral shift position. If the actuator 96D is controlled to place the slide unit 67 to the forward shift position from the neutral shift position, the actuating member 98 is retracted toward the housing of the actuator 96D and simultaneously the housing of the actuator 96D swings clockwise about the axis of the connecting pin 152. The slide unit 67 moves forward toward the front end of the slot 73 and the actuating member 98 slightly approaches the center plane CP because the slide unit 67 approaches the center plane CP. The connecting member 74 thus moves as indicated by the phantom line 74*c* in the figure. The lever unit 66 pivots counter-clockwise as indicated by the phantom line 66*c* to rotate the shift rod 64 also counter-clockwise.

On the other hand, if the actuator 96D is controlled to place the slide unit 67 to the reverse shift position from the neutral shift position, the actuating member 98 extends outward. The slide unit 67 moves rearward toward the rear end of the slot 73 and the housing of the actuator 96D swings counter-clockwise about the axis of the connecting pin 152 because the slide unit 67 moves farther from the center plane CP. The connecting member 74 thus moves as indicated by the phantom line 74*d*. The lever unit 66 pivots clockwise as indicated by the phantom line 66*d* to rotate the shift rod 64 also clockwise.

Figure 21:
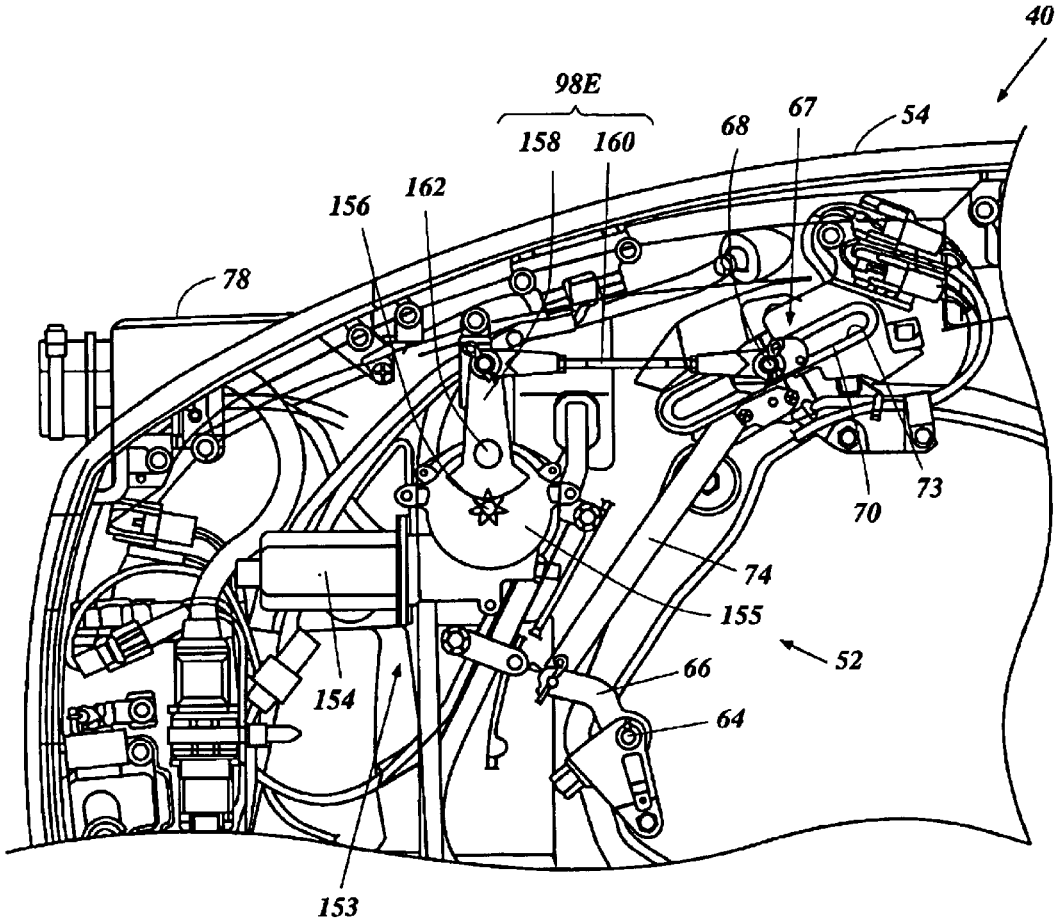
FIG. 21 illustrates an enlarged top plan view of the outboard motor without the top cowling member, wherein a shift actuator, which includes a rotary shaft, is arranged in accordance with a sixth embodiment of the present invention.
Figure 22:
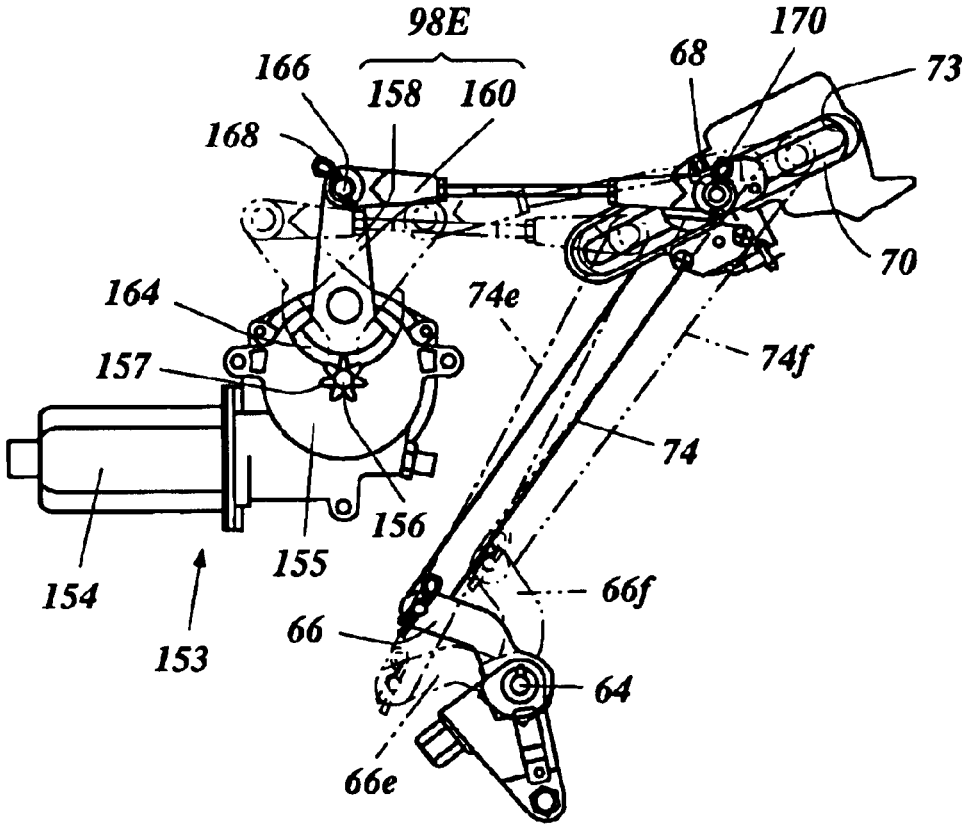
FIG. 22 illustrates a top plan view of the arrangement of FIG. 21, wherein three positions of a lever of the electric motor, the actuating member, the connecting member and the lever unit shown in actual and phantom lines.
Figure 23:
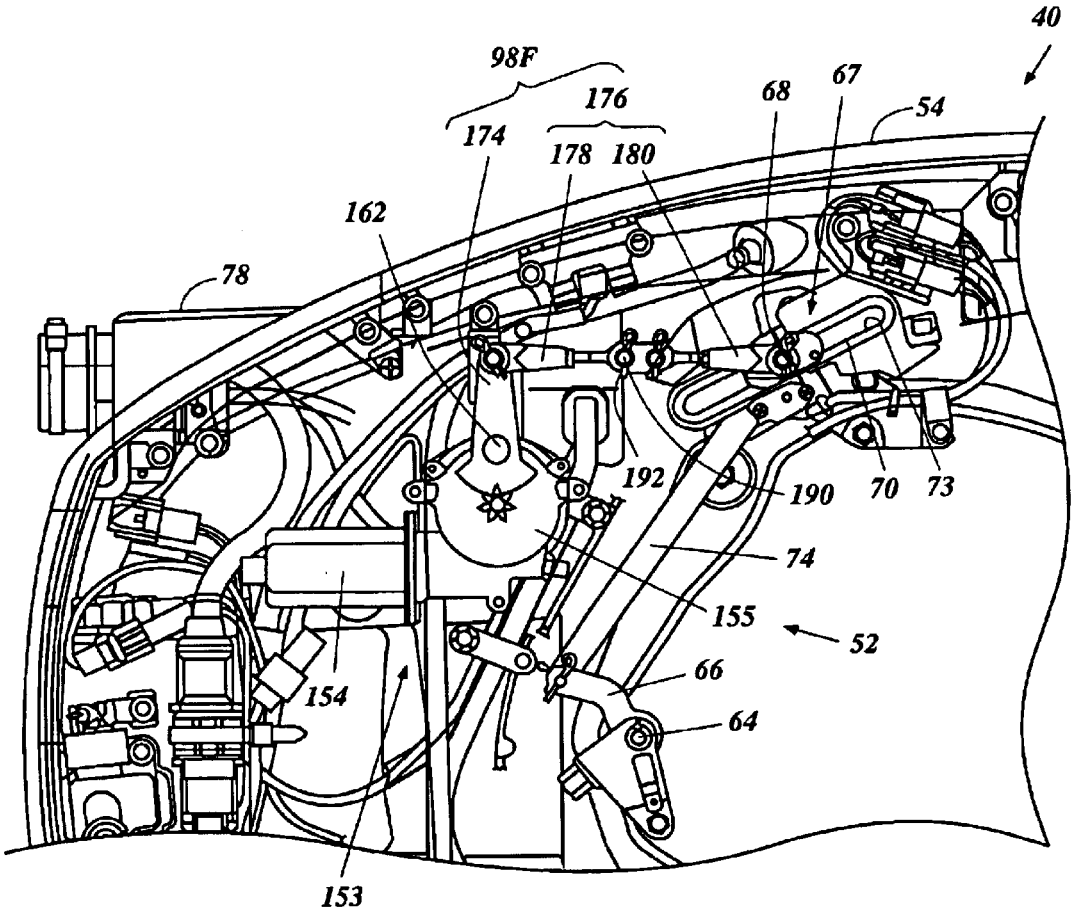
FIG. 23 illustrates an enlarged top plan view of the outboard motor without the top cowling member, wherein a shift actuator, including an electric motor, is arranged in accordance with a seventh embodiment of the present invention.
Figure 24:
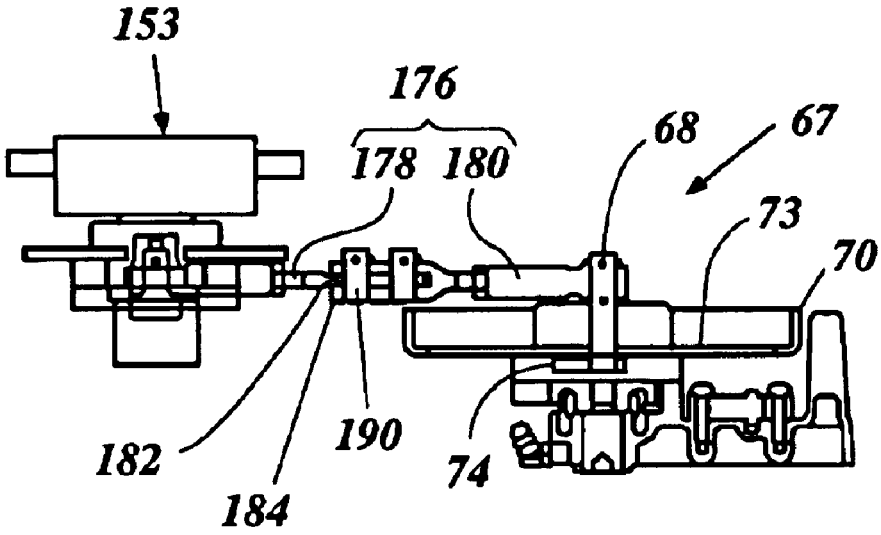
FIG. 24 illustrates a side elevational view of the arrangement of FIG. 23 as isolated from the balance of the outboard motor.

With reference to FIGS. 21 and 22, a sixth preferred embodiment of the electrical shift control system, which is configured in accordance with certain features, aspects and advantages of the present invention, is described below.

A shift actuator 153 in this embodiment, unlike the actuators described above, preferably comprises an electric motor 154 (or another type of rotary actuator) and a reduction gear assembly 155. The electric motor has a motor shaft extending generally horizontally fore to aft. The reduction gear assembly 155 is affixed to the electric motor 154 and includes a reduction gear or reduction gear train that is connected to the motor shaft of the electric motor 154. An output shaft or rotary shaft 156 extends generally vertically from a housing of the reduction gear assembly 155. The output shaft 156 has a pinion 157 at a top end therof. Because the reduction gear or reduction gear train of the reduction gear assembly 155 reduces speed of rotation, the output shaft 156 rotates at a speed slower than a speed of the motor shaft.

The actuator 153 preferably has an actuating member 98E that comprises a first section 158 and a second section 160. The first section 158 in this embodiment is a lever that can pivot about a vertical axis of a pivot shaft 162, which is preferably affixed atop of the housing of the reduction gear assembly 153. One end of the first section 158 generally horizontally extends toward the side surface of the bottom cowling member on the starboard side. The other end of the first section 158 has a fan-like shaped gear 164 that meshes the pinion 157.

The second section 160 in this embodiment is a rod that has joint portions on both ends. One of the joint portions is pivotally coupled with the end of the first section or lever 158 via a connecting pin 166. A clip 168 prevents the joint portion from coming off the connecting pin 168. The other joint portion is pivotally coupled with the slide pin 68 of the slide unit 67. Another clip 170 prevents the joint portion from coming off the slide pin 68. The second section or rod 160 thus extends between the end of the lever 158 and the slide pin 68. An axis of the rod 160 is skewed relative to the axis of the slot 73.

With reference to FIG. 22, the slide unit 67 is positioned generally at the center of the slot 73 as indicated by the solid lines in the figure when the shift actuator 153 is controlled by the ECU 60 to set the slide unit 67 at the neutral shift position. Under this condition, the lever 158 and the rod 160 are preferably generally oriented normal to each other.

If the actuator 153 is controlled to place the slide unit 67 to the forward shift position from the neutral shift position, the output shaft 156 rotates clockwise. The pinion 157 on the output shaft 156 thus drives the lever 158 via the meshed gear 164 on the lever 158. The lever 158 pivots counter-clockwise about the axis of the pivot shaft 162. The rod 98E moves forward to slide the slide unit 67 also forward toward the front end of the slot 73. In this movement, the sections 158, 160 of the rod 98E create an acute angle between themselves because the slide unit 67 approaches the fixed pivot shaft 162. The connecting member 74 thus moves as indicated by the phantom line 74*e*. The lever unit 66 pivots counter-clockwise as indicated in the figure by the phantom line 66*e* to rotate the shift rod 64 also counter-clockwise.

On the other hand, if the actuator 153 is controlled to place the slide unit 67 to the reverse shift position from the neutral shift position, the output shaft 156 rotates counter-clockwise. The pinion 157 on the output shaft 156 thus drives the lever 158 via the meshed gear 164 on the lever 158. The lever 158 pivots clockwise about the axis of the pivot shaft 162. The rod 98E moves rearward to slide the slide unit 67 also rearward toward the rear end of the slot 73. In this movement, the sections of the rod 98E create an obtuse angle between themselves because the slide unit 67 moves away from the pivot shaft 162. The connecting member 74 thus moves as indicated by the phantom line 74*f*. The lever unit 66 pivots clockwise as indicated by the phantom line 66*f* to rotate the shift rod 64 also clockwise.

Because, in this sixth embodiment, the actuating member 98E comprises the lever 158 and the rod 160 which are pivotally coupled with each other and can take almost any angle relative to each other, the shift actuator 153 can be placed at a location in an area which is relatively large on the bottom cowling member 54.

With reference to FIGS. 23–26, a seventh preferred embodiment of the electrical shift control system, which is configured in accordance with certain features, aspects and advantages of the present invention, is described below.

The same type of shift actuator 153 that is used in the sixth embodiment preferably is used in this embodiment as well also. A separate type of actuating member 98F, however, is employed instead of the actuating member 98E used in the sixth embodiment so as to operate the shift mechanism 52 manually in the event of malfunction of the electric motor 154 or any other electric components within the system. The illustrated actuating member 98F principally comprises a first section 174 and a second section 176. Other components and arrangements of the system are the same as those in the sixth embodiment.

The first section 174 preferably is the same lever as that used in the sixth embodiment. The second section 176 preferably is a rod that comprises a first rod piece 178 and a second rod piece 180. The first rod piece 178 has a joint portion and a coupling portion 182. The second rod piece 180 has a joint portion and a coupling portion 184. The joint portion of the first piece 178 is pivotally coupled with the end of the first section or lever 174 via a connecting pin while the joint portion of the second rod piece 180 is pivotally coupled with the slide pin 68 of the slide unit 67.

The coupling portion 182 of the first rod piece 178 has two openings 186 (FIG. 25) that line along a longitudinal axis of the first rod piece 178. The coupling portion 184 of the second rod piece 180 is bifurcated vertically and the bifurcated ends are spaced apart from each other. Each bifurcated end preferably has two openings 188 (FIG. 25) that are spaced apart from each other along a longitudinal axis of the second rod piece 180. A first set of the openings 188 of the second rod piece 180 has the same size and position as those of one of the openings 186 of the first rod piece 178. The other set of the openings 188 of the second rod piece 180 has the same size and position as those of the other opening 186 of the first rod piece 178. A connecting pin 190 is inserted into each group of openings 186, 188 to rigidly couple the first and second rod pieces 178, 180. As shown in FIG. 26, the connecting pins 190 preferably are connected with each other and are spaced apart by the same distance as that which separates the openings 186, 188 that are lined side by side. A clip 192 is affixed to a top end of each connecting pin 190 to prevent the connecting pin 190 from slipping off the assembly.

Figure 25:
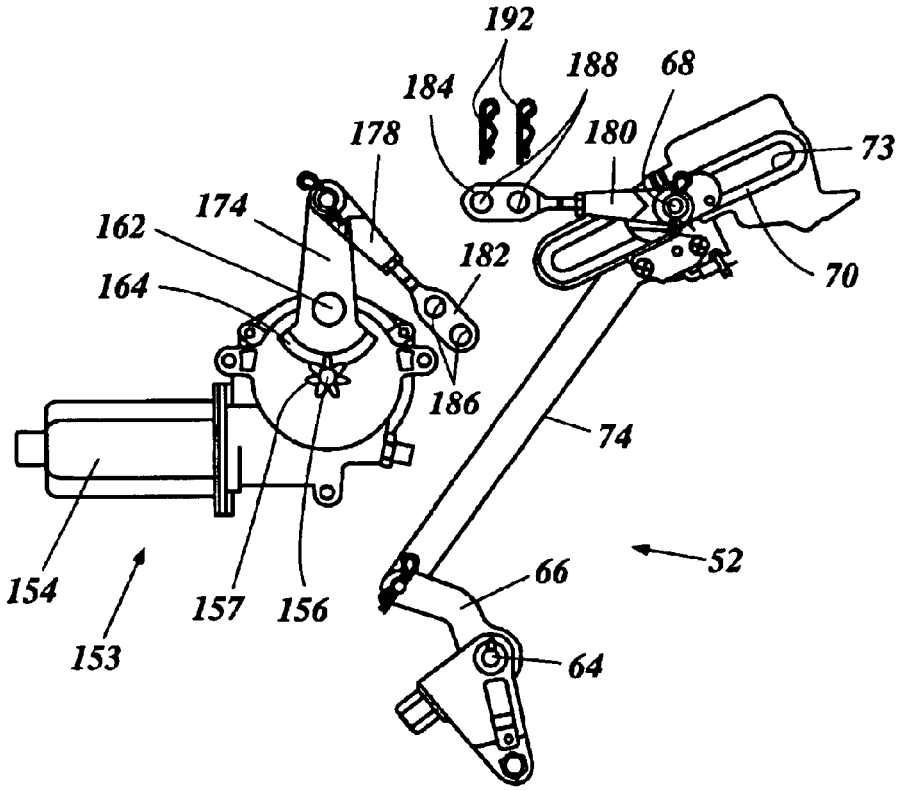
FIG. 25 illustrates a top plan view of the arrangement of FIG. 23, wherein the two sections of the actuating member are disconnected.
Figure 26:
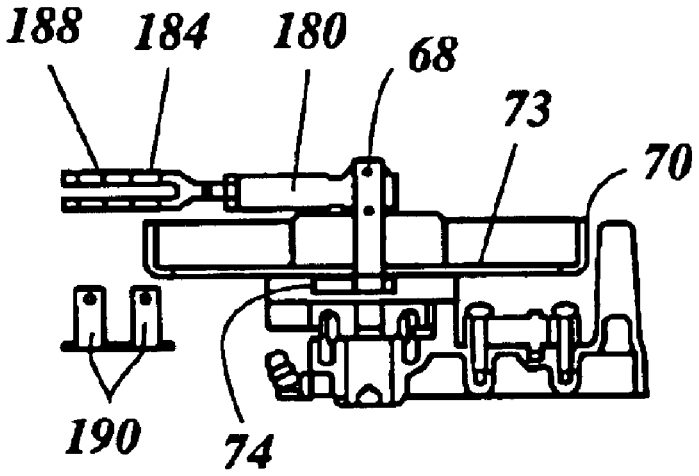
FIG. 26 illustrates a side elevational view of the arrangement of FIG. 23, wherein the actuator, the lever and one section of the actuating member extending from the lever are not shown.

With reference to FIGS. 25 and 26, in order to manually operate the shift mechanism 52, the first and second rod pieces 178, 180 can be separated from each other. The clips 192 are removed and then the connecting pins 190 are extracted from the openings 186, 188. The second rod piece 180 remains on the slide unit 67. The operator thus can operate the shift mechanism 52 by the second rod piece 180.

Figure 27:
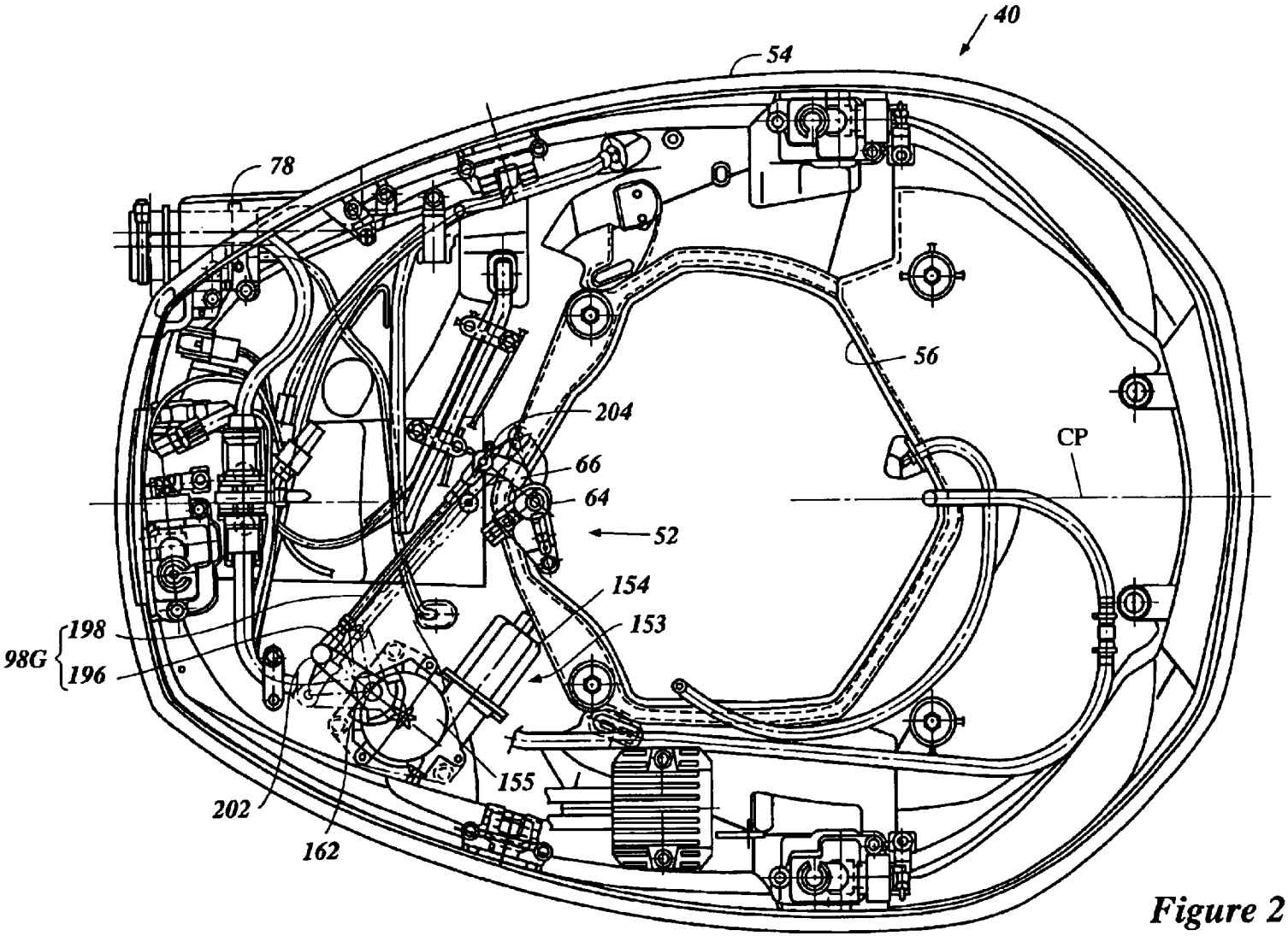
FIG. 27 illustrates an enlarged top plan view of the outboard motor without the top cowling member, wherein a shift actuator is arranged in accordance with an eighth embodiment of the present invention.
Figure 28:
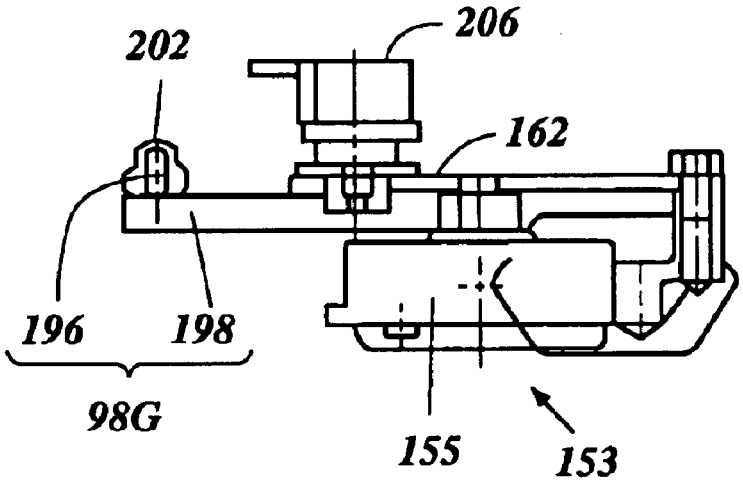
FIG. 28 illustrates one side elevational view of the arrangement of FIG. 27, showing a shift position sensor.
Figure 29:
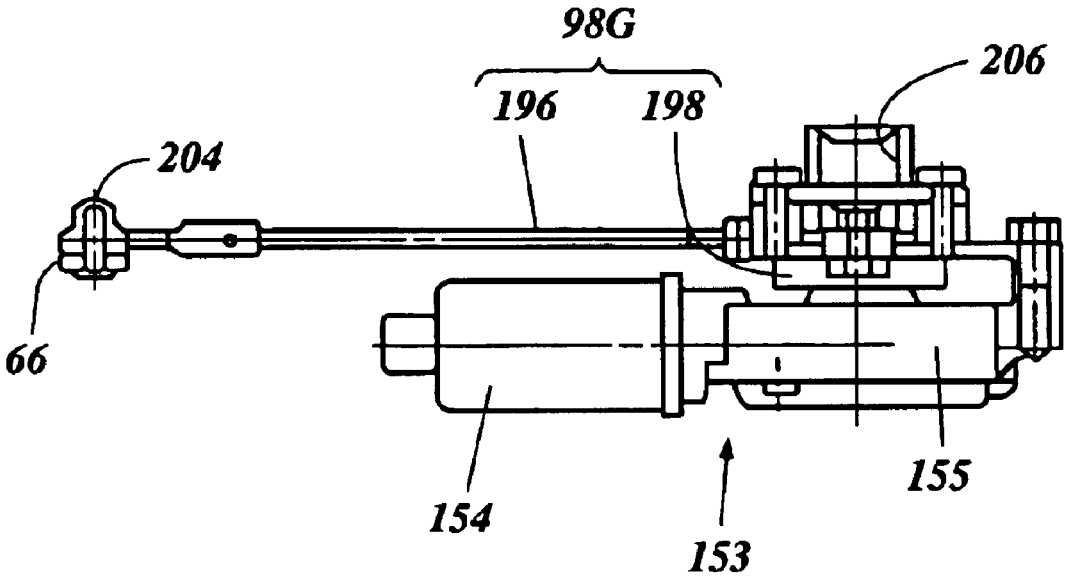
FIG. 29 illustrates another side elevational view of the arrangement of FIG. 27.

With reference to FIGS. 27–29, an eighth preferred embodiment of the electrical shift control system, which is configured in accordance with certain features, aspects and advantages of the present invention, is described below.

The foregoing slide unit 67, the guide member 70 and the connecting member 74 are removed in this embodiment. The shift actuator 153, which comprises the electric motor 154 and the reduction gear assembly 155, preferably is located generally in front of the opening 56 of the bottom cowling member 54 and on the port side of the bottom cowling member 54. Because the slide unit 67 is removed, the shift actuator 153 is directly coupled with the lever unit 66, which is a shift unit in this embodiment, through an actuating member 98G.

The actuating member 98G is similar to the actuating member 98E of the sixth embodiment and has a first section 196 and a second section 198 both constructed similarly to those of the sixth embodiment (FIGS. 21 and 22). The first section or lever 196 pivots about an axis of the pivot shaft 162. One end of the second section or rod 198 is pivotally coupled with the lever 196 via a connecting pin 202, while the other end of the rod 198 is pivotally coupled with the lever unit 66 via a connecting pin 204. A distance between an axis of the pivot shaft 162 and an axis of the connecting pin 202 preferably is generally equal to a distance between the axis of the shift rod 64 and an axis of the connecting pin 204. Also, a length of the rod 96 is determined such that a line connecting the axis of the pivot shaft 162 and the axis of the connecting pin 202 extends generally parallel to a line connecting the axis of the shift rod 64 and the axis of the connecting pin 204. The lever unit 66 pivots clockwise or counter-clockwise in response to the pivotal movement of the lever 196 when the actuator 153 actuates the lever 196 and rotates the shift rod 64 accordingly.

A position sensor 206 such as, for example, a potentiometer preferably is affixed to the pivot shaft 162 to sense the pivotal movement of the lever 196 that is coupled with the pivot shaft 162. An output signal of the position sensor 206 is sent to the ECU 60 and is used to determine whether the lever 196 moves normally in accordance with the shift command provided to the ECU 60 from the remote controller 106. The output signal also can be used to determine whether some repair is necessary to the actuator 98G or related components.

The shift mechanism 52 is in the neutral position when the lever 196, the rod 198 and the lever unit 66 is positioned as indicated by the solid lines in FIG. 27. The shift mechanism 52 is changed to the forward position while the lever 196 and the lever unit 66 are moving counter-clockwise, and the shift mechanism 52 is changed to the reverse position while the lever 196 and the lever unit 66 are moving clockwise. The positions of the lever 196 and the lever unit 66 corresponding to the forward and reverse positions are indicated by the phantom lines.

The foregoing neutral switch can be affixed to the pivot shaft 162 together with the position sensor 206. Alternatively, the output signal of the position sensor 206 that is generated when the shift mechanism 52 is in the neutral position can be used as a neutral signal that is equivalent to a signal that is generated when the neutral switch is turned on. The starter motor or other starting devices of the engine 38 is allowed to start the engine 38 when the neutral switch is turned on as described above.

If the shift actuator 153 malfunctions, the rod 198 is simply detached from the lever unit 66 so as to manually operate the lever unit 66.

As described above, the slide unit, the guide unit and the connecting member are not used and, preferably, in this embodiment, and the rod 198 is directly coupled with the lever unit 66. The shift actuator 153, therefore, can be placed at any position and, preferably, in an area in front of the opening 56. This area is broader than an area that extends in front of the guide unit in the foregoing embodiments.

Figure 30:
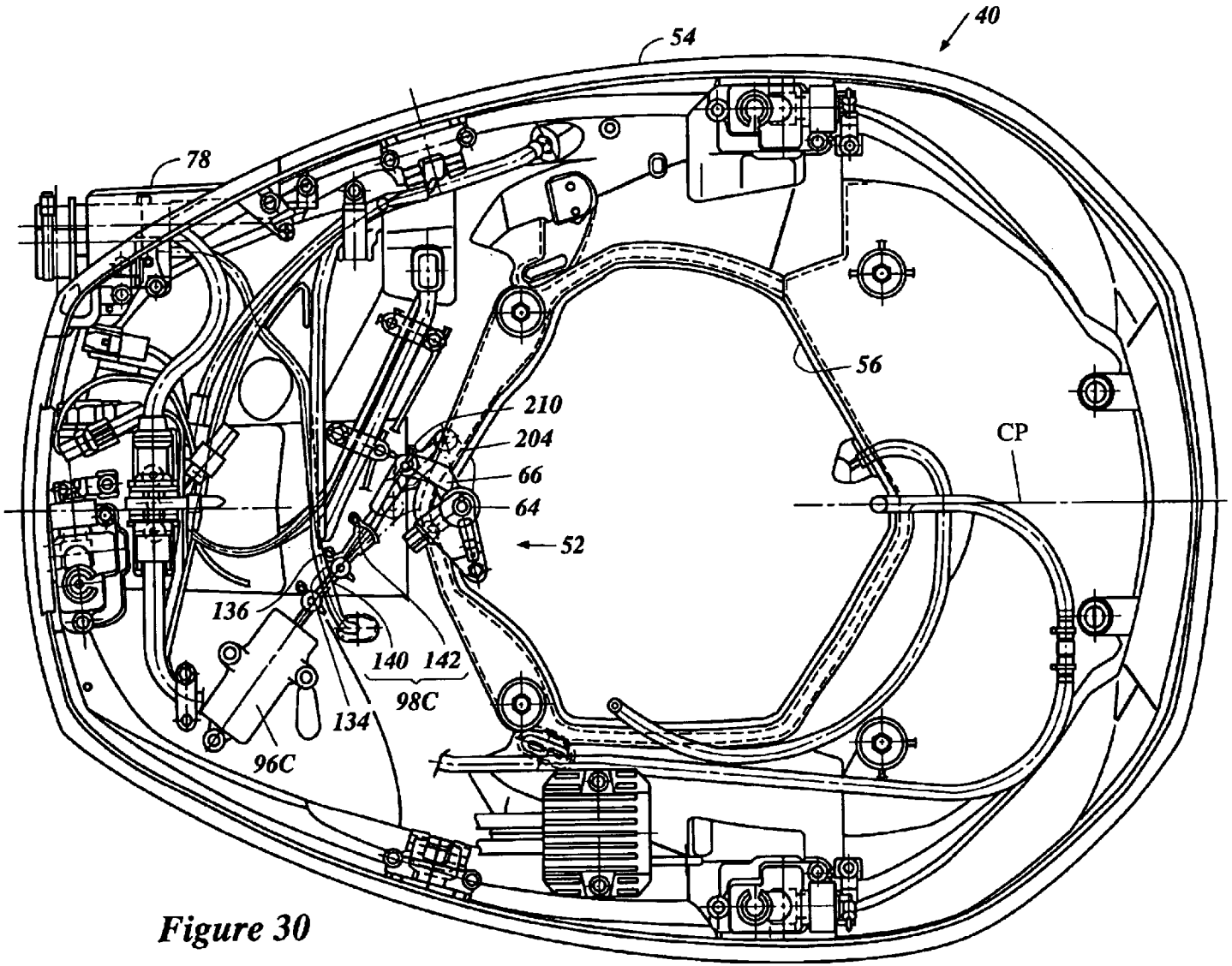
FIG. 30 illustrates a top plan view of the outboard motor without the top cowling member and with a shift actuator arranged in accordance with a ninth embodiment of the present invention, wherein the actuating member also is directly coupled with the lever unit, and two sections of the actuating member are pivotally connected with each other.

With reference to FIG. 30, a ninth preferred embodiment of the electrical shift control system configured, which is in accordance with certain features, aspects and advantages of the present invention, is described below.

Similarly to the eighth embodiment, the foregoing slide unit 67, the guide member 70 and the connecting member 74 are removed in this embodiment. The shift actuator 96C, which in the embodiment comprises electromagnetic solenoid similar to that used in the fourth embodiment (FIGS. 13–17), is located generally in front of the opening 56 of the bottom cowling member 54 and on the port side of the bottom cowling member 54. Because the slide unit 67 is removed, the shift actuator 96C is directly coupled with the lever unit 66 through the actuating member 98C. That is, the actuating member 98C comprises the first section 140 and the second section 142. The joint portion of the second section 142 in this embodiment is pivotally coupled with the lever unit 66 via the connecting pin 204. A clip 210 is affixed to the connecting pin 204 to prevent the connecting pin 204 from slipping off. The actuating member 98C preferably is disposed generally normal to the lever unit 66 as indicated by the solid lines in the figure when the shift mechanism 52 is in the neutral position. Additionally, the lever unit 66 and the actuating member 98C move as indicated by the phantom lines when the shift mechanism 52 is changed to the forward or reverse position.

A position sensor similar to the position sensor 206 is enclosed within the housing of the shift actuator 96C in this embodiment. The position sensor senses a reciprocal position of the first section 140.

The ninth embodiment can be provided so as to achieve some or all of the advantages of the fourth and eighth embodiments.

Figure 31:
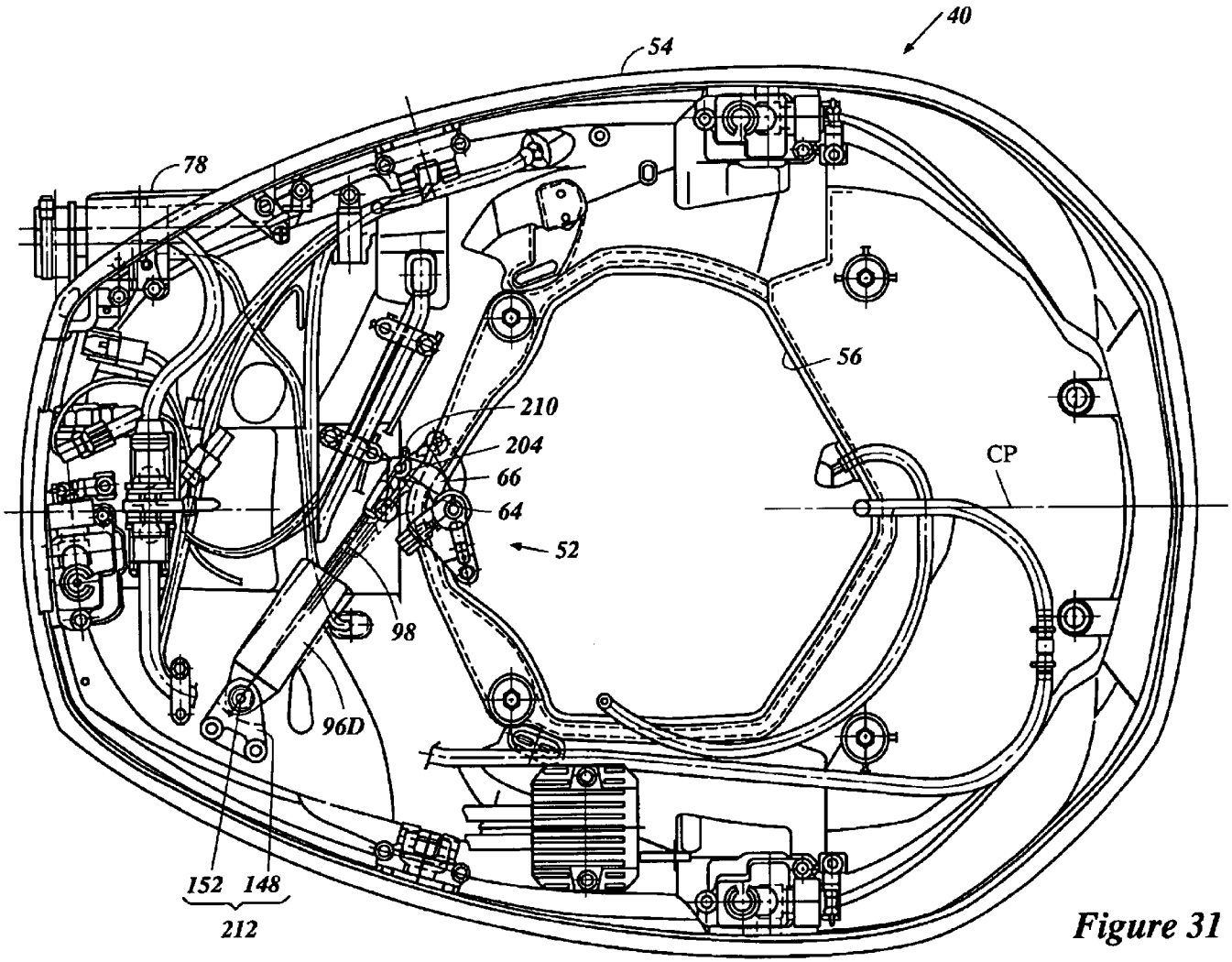
FIG. 31 illustrates a top plan view of the outboard motor without the top cowling member and a shift actuator arranged in accordance with a tenth embodiment of the present invention, wherein the actuating member also is directly coupled with the lever unit, and the housing of the actuator is pivotally affixed onto the lower cowling member.
Figure 32:
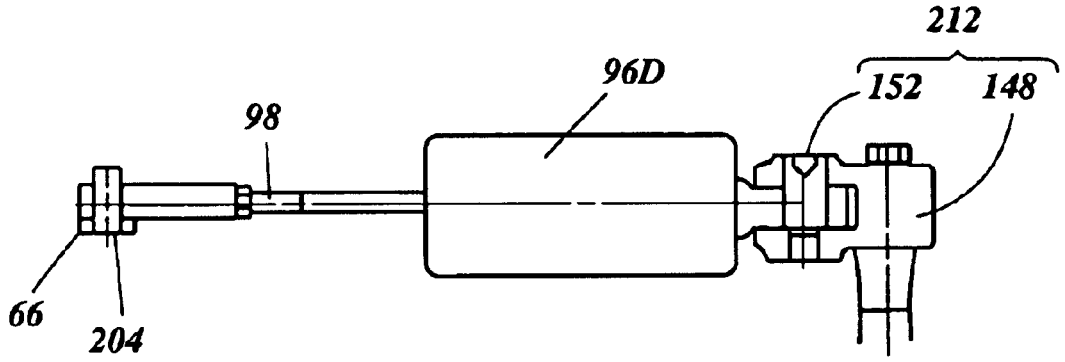
FIG. 32 illustrates a side elevational view of the arrangement of FIG. 31.

With reference to FIGS. 31–32, a tenth preferred embodiment of the electrical shift control system, which is configured in accordance with certain features, aspects and advantages of the present invention, is described below.

Similarly to the eighth embodiment and the ninth embodiment, the foregoing slide unit 67, the guide member 70 and the connecting member 74 are removed in this embodiment. The shift actuator 96D, which comprises electromagnetic solenoid and is similar to that used in the fifth embodiment (FIGS. 18–20), is located generally in front of the opening 56 of the bottom cowling member 54 and on the port side of the bottom cowling member 54. Because the slide unit 67 is removed, the shift actuator 96D is directly coupled with the lever unit 66 through the actuating member 98. The housing of the actuator 96D is pivotally affixed onto the bottom cowling member 54 by the support unit 212 that comprises the support member 148 and the connecting pin 152. The joint portion of the actuating member 98 in this embodiment is pivotally coupled with the lever unit 66 via the connecting pin 204. The actuating member 98 preferably is disposed generally normal to the lever unit 66 as indicated by the solid lines in FIG. 31 when the shift mechanism 52 is in the neutral position. Additionally, the lever unit 66 and the actuating member 98 move as indicated by the phantom lines when the shift mechanism 52 is changed to the forward or reverse position.

The tenth embodiment can be configured and arranged to provide some or all of the advantages of the fifth and eighth embodiments.

Figure 33:
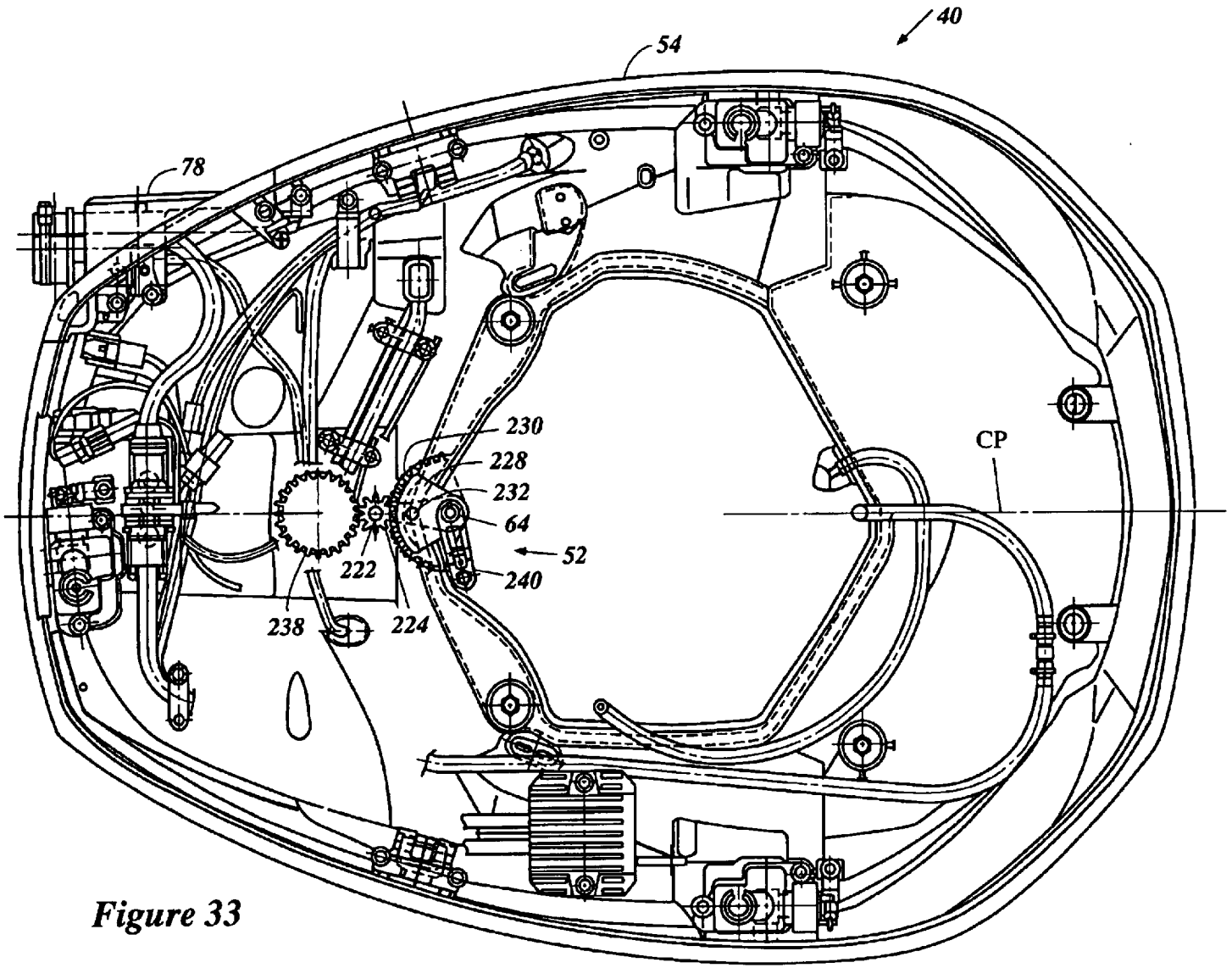
FIG. 33 illustrates a top plan view of the outboard motor without the top cowling member and a shift actuator arranged in accordance with an eleventh embodiment of the present invention, wherein the rotary shaft of the actuator and the lever unit are coupled with each other through a gear connection.
Figure 34:
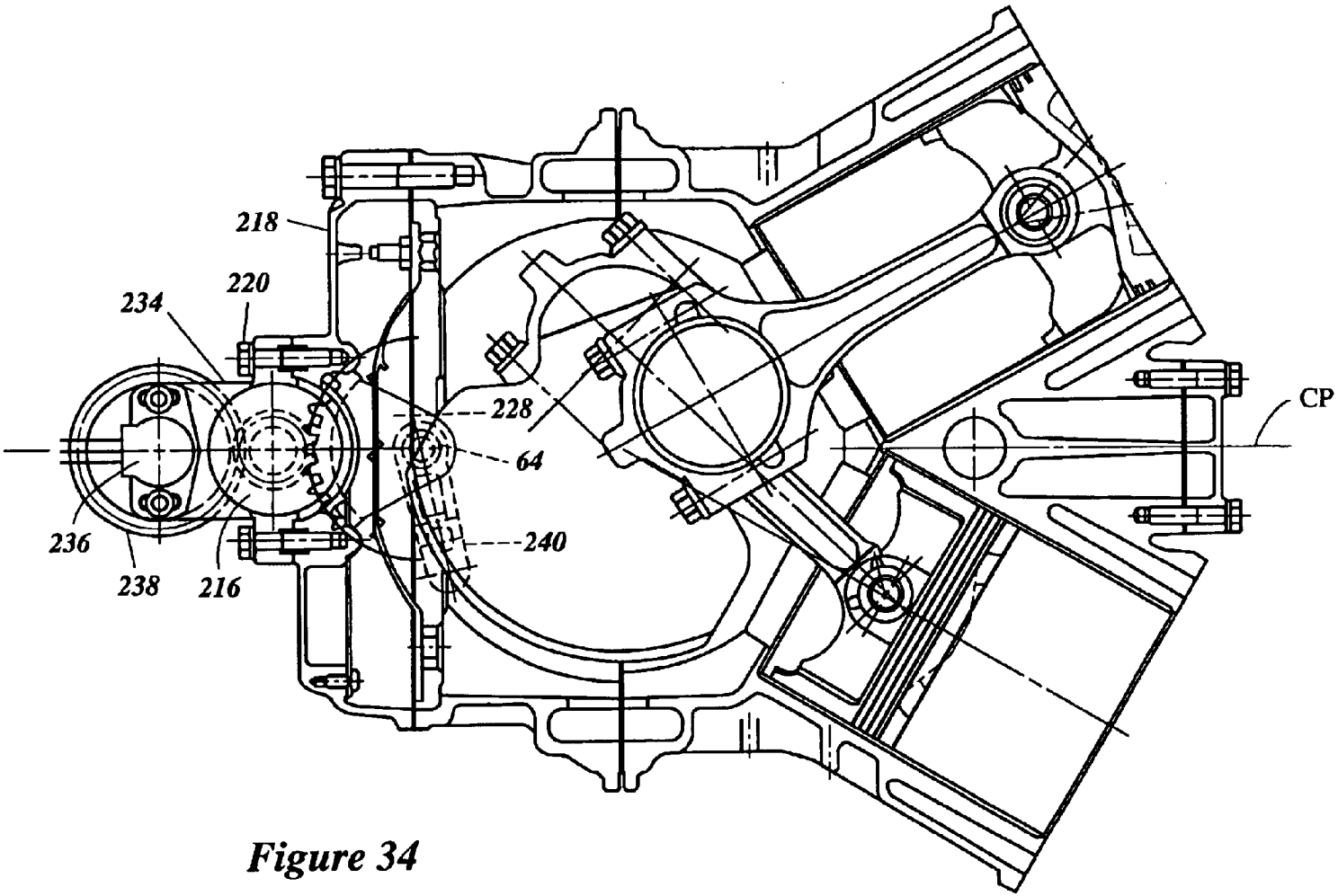
FIG. 34 illustrates an enlarged top plan view of the arrangement of FIG. 33, wherein the shift actuator is affixed onto a crankcase of an engine of the outboard motor, the engine being indicated in section, and the shift position sensor is coupled with the rotary shaft of the actuator through another gear connection.
Figure 35:
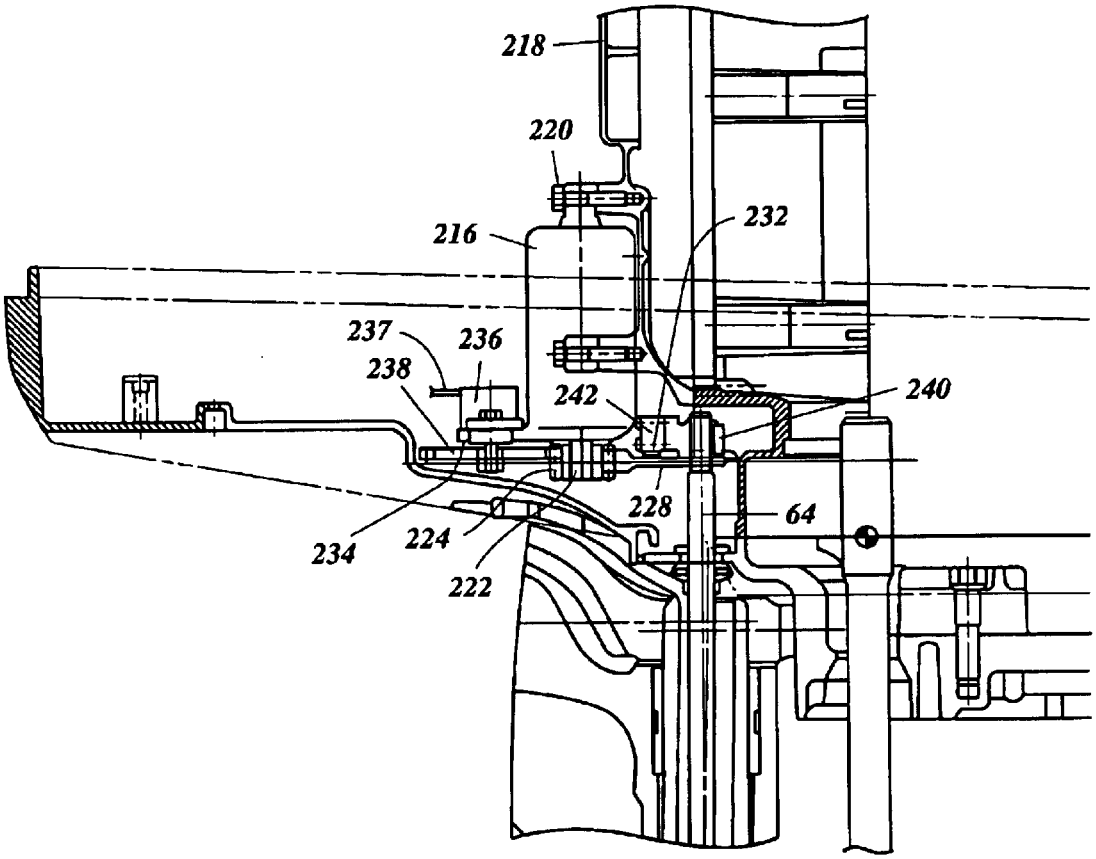
FIG. 35 illustrates an enlarged side elevational view of the arrangement of FIG. 33, wherein a neutral switch turned by a geared lever unit also is shown.

With reference to FIGS. 33–35, an eleventh preferred embodiment of the electrical shift control system, which is configured in accordance with certain features, aspects and advantages of the present invention, is described below.

A shift actuator 216 in this embodiment preferably is affixed to a front surface of a crankcase 218 of the engine 38 by bolts 220. The engine in turn, as noted above, is supported by the drive unit 40. The shift actuator 216 (FIG. 35) preferably comprises an electric motor that has a rotary shaft 222 extending generally vertically. An axis of the rotary shaft or output shaft 222 preferably extends on the center plane CP. A pinion 224 is affixed to a bottom end of the rotary shaft 222. The pinion 224 is positioned right in front of a top portion of the shift rod 64. A fan-like shaped lever member 228 that has gear teeth 230 is affixed to the top portion of the shift rod 64 and meshes the pinion 224. The lever member 228 is a shift unit in this embodiment. The lever member 228 preferably has a small projection 232 that extends upward. The projection 232 is placed at a center of the lever member 228 and can be positioned when the lever member 228 is placed at a position corresponding to the neutral position of the shift mechanism 52.

A housing of the actuator 216 preferably has a support section 234 that is unitarily formed with the housing and extends horizontally and forwardly from a front bottom end of the actuator housing. An angular position sensor 236 is disposed above the support section 234 and is affixed to the support section 234. The position sensor 236 thus is located opposite to the shift rod 64 relative to the rotary shaft 222. The position sensor 236 preferably is a potentiometer that has a sensor shaft extending generally vertically. A gear 238 is affixed to the sensor shaft and meshes the pinion 222. An output of the position sensor 236 is sent to the ECU 60.

A bracket 240 is affixed to a top surface of the exhaust guide member (not shown). An end of the bracket 240 is pivotally coupled with a top end portion of the shift rod 64 so as to fix the top end portion relative to the exhaust guide member. Although not shown in FIGS. 33 and 34, the bracket 240 has a portion extending to the projection 232. As shown in FIG. 35, a neutral switch 242 (FIG. 35) is affixed to the extended portion of the bracket. In the illustrated embodiment, the neutral switch 242 is always positioned on the center plane CP. The neutral switch 242 has a contact portion slightly extending downward. The projection 232 meets the contact portion and presses the contact portion when the lever member 228 is placed at a position corresponding to the neutral position of the shift mechanism 52. The neutral switch 242 is activated when the projection presses the contact portion. An active signal is sent to the ECU 60.

As thus constructed, the lever member 228 is positioned with the projection 232 placed generally on the center plane CL as indicated by the solid lines of FIG. 33 when the shift mechanism 52 is in the neutral position. The neutral switch 242 is activated and the ECU 60 allows the engine 38 to be started. The actuator 216 rotates the lever member 228 clockwise or counter-clockwise through the pinion 222 and the gear teeth on the lever member 228. In the illustrated embodiment, when the lever member 228 is rotated clockwise, the shift mechanism 52 is changed to the forward position from the neutral position. When the lever member 228 is rotated counter-clockwise, the shift mechanism 52 is changed to the reverse position from the neutral position. Simultaneously, the actuator 216 drives the position sensor 236. The position sensor 236 thus senses a position of the lever member 228 and sends a signal to the ECU 60. The ECU 60 thus can determine whether the lever member 228 moves normally in accordance with the shift command provided to the ECU 60 from the remote controller 106.

Because the gear connection is used in this embodiment, drive force is accurately conveyed from the actuator 216 to the shift rod 64. Thus, a precise control of the shift mechanism 52 is assured.

Also, the actuator 216 in this embodiment is vertically disposed on a front surface of the crankcase. A relatively small space is required to arrange related components on the top surface of the bottom cowling member 54.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A marine drive comprising a drive body, a propulsion device extending from the drive body, a transmission coupled with the propulsion device, and a shift mechanism arranged to move the transmission between a first position in which the propulsion device is set to a first mode and a second position in which the propulsion device is set to a second mode, the shift mechanism comprising a shift unit linearly movable between a first shift position and a second shift position, the transmission moving to the first position while the shift unit moves toward the first shift position, the transmission moving to the second position while the shift unit moves toward the second shift position, and an electrically operable shift actuator supported by the drive body, the shift actuator having an actuating member detachably coupled to the shift unit.

2. The marine drive as set forth in claim 1, wherein the actuating member linearly extends and retracts relative to a housing of the shift actuator along an axis of the actuating member.

3. The marine drive as set forth in claim 2, wherein the axis of the actuating member coincides with an axis of the movement of the shift unit.

4. The marine drive as set forth in claim 2, wherein the axis of the actuating member is skewed with respect to an axis of the movement of the shift unit, the actuating member comprises first and second sections pivotally coupled with each other, the first section extends from the housing of the actuator, and the second section is coupled with the shift unit to pivot about an axis of the shift unit.

5. The marine drive as set forth in claim 2, wherein the axis of the actuating member is skewed with respect to an axis of the movement of the shift unit, and the housing of the actuator is pivotally coupled to the drive body.

6. The marine drive as set forth in claim 2, wherein the actuating member comprises first and second sections detachably coupled with each other, the first section extends from the housing of the actuator and the second section extends from the shift unit.

7. The marine drive as set forth in claim 2, wherein the shift actuator comprises an electromagnetic solenoid.

8. The marine drive as set forth in claim 1, wherein the shift actuator comprises a rotary shaft, the actuating member is coupled with the rotary shaft through a lever that pivotally moves when the rotary shaft rotates.

9. The marine drive as set forth in claim 8, wherein an axis of the actuating member is skewed with respect to an axis of the movement of the shift unit, and the lever is pivotally connected to the actuating member.

10. The marine drive as set forth in claim 1, wherein the shift mechanism additionally comprises a guide member that defines a slot having a linear axis, and the shift unit is slideably movable along the linear axis of the slot.

11. The marine drive as set forth in claim 1, wherein an operating member is coupled with the shift unit in addition to the actuating member.

12. The marine drive as set forth in claim 1, wherein the shift mechanism additionally comprises a second shift unit coupled with the first shift unit, the second shift unit is positioned closer to the transmission in a connection linkage of the shift mechanism.

13. The marine drive as set forth in claim 1 additionally comprising a prime mover that powers the propulsion device, either the first or second modes of the propulsion device being a neutral mode in which the propulsion device is disconnected from the prime mover, the shift mechanism additionally comprising a neutral position sensor that senses that the shift unit is placed at the respective one of either the first or second shift positions that corresponds to the neutral mode of the propulsion device.

14. The marine drive as set forth in claim 13, wherein the neutral position sensor is a neutral position switch disposed adjacent to the shift unit or the actuating member, and the movement of the shift unit or the actuating member to effect the neutral mode activates the neutral position switch.

15. A marine drive comprising a drive body, a propulsion device extending from the drive body, a transmission coupled with the propulsion device, and a shift mechanism arranged to move the transmission between a first position in which the propulsion device is set to a first mode and a second position in which the propulsion device is set to a second mode, the shift mechanism comprising a shift unit pivotally movable between a first shift position and a second shift position, the transmission moving to the first position while the shift unit moves toward the first shift position, the transmission moving to the second position while the shift unit moves toward the second shift position, and an electrically operable shift actuator supported by the drive body, the shift actuator having a rotary shaft and an actuating member coupled with the rotary shaft and with the shift unit.

16. The marine drive as set forth in claim 15, wherein one end of the actuating member is coupled with the rotary shaft through a lever that pivotally moves when the rotary shaft rotates, and another end of the actuating member is pivotally coupled with the shift unit.

17. The marine drive as set forth in claim 15, wherein the actuating member comprises a first gear coupled with the rotary shaft, and the shift unit comprises a second gear meshing the first gear.

18. The marine drive as set forth in claim 17, wherein a third gear meshes with one of the first or second gears, a shift position sensor cooperates with the third gear to sense a position of the shift unit.

19. A marine drive comprising a drive body, a propulsion device extending from the drive body, a transmission coupled with the propulsion device, and a shift mechanism arranged to move the transmission between a first position in which the propulsion device is set to a first mode and a second position in which the propulsion device is set to a second mode, the shift mechanism comprising a shift unit pivotally movable between a first shift position and a second shift position, the transmission moving to the first position while the shift unit moves toward the first shift position, the transmission moving to the second position while the shift unit move toward the second shift position, and an electrically operable shift actuator supported by the drive body, the shift actuator having a rotary shaft and an actuating member coupled with the rotary shaft and with the shift unit, the actuating member comprising first and second sections pivotally coupled with each other, the first section linearly extending and retracting relative to a housing of the shift actuator along an axis of the first section, the second section pivotally coupled with the shift unit.

20. A marine drive comprising a drive body, a propulsion device extending from the drive body, a transmission coupled with the propulsion device, and a shift mechanism arranged to move the transmission between a first position in which the propulsion device is set to a first mode and a second position in which the propulsion device is set to a second mode, the shift mechanism comprising a shift unit pivotally movable between a first shift position and a second shift position, the transmission moving to the first position while the shift unit moves toward the first shift position, the transmission moving to the second position while the shift unit moves toward the second shift position, and an electrically operable shift actuator supported by the drive body, the shift actuator having a rotary shaft and an actuating member coupled with the rotary shaft and with the shift unit, the actuating member linearly extending and retracting relative to a housing of the shift actuator, the housing of the shift actuator swingably affixed to the drive body.

21. A marine drive comprising a drive body, a propulsion device extending from the drive body, a transmission coupled with the propulsion device, and a shift mechanism arranged to move the transmission between a first position in which the propulsion device is set to a first mode and a second position in which the propulsion device is set to a second mode, the shift mechanism comprising a shift unit movable between a first shift position and a second shift position, the transmission moving to the first position while the shift unit moves toward the first shift position, the transmission moving to the second position while the shift unit moves toward the second shift position, an electrically operable shift actuator supported by the drive body, the shift actuator having an actuating member coupled with the shift unit, and a shift position sensor that senses a position of the shift unit placed between the first and second shift positions.

22. The marine drive as set forth in claim 21, wherein the shift position sensor is disposed near the shift actuator to sense a position of the shift actuator that corresponds to the position of the shift unit.

23. The marine drive as set forth in claim 21, wherein the shift position sensor is disposed in a housing of the shift actuator to sense a position of the shift actuator that corresponds to the position of the shift unit.

24. The marine drive as set forth in claim 21 additionally comprising a prime mover that powers the propulsion device, either one of the first or second modes of the propulsion device being a neutral mode in which the propulsion device is disconnected from the prime mover, the shift mechanism additionally comprising a neutral position sensor that senses when the shift unit is placed at either of the first or second shift positions which corresponds to the neutral mode of the propulsion device.

25. A marine drive comprising a propulsion device, a prime mover that powers the propulsion device, a transmission coupled with the propulsion device, and a shift mechanism arranged to move the transmission between a first position in which the propulsion device is set to a first mode and a second position in which the propulsion device is set to a second mode, the shift mechanism comprising a shift unit movable between a first shift position and a second shift position, the transmission moving to the first position while the shift unit moves toward the first shift position, the transmission moving to the second position while the shift unit moves toward the second shift position, and an electrically operable shift actuator having an actuating member coupled with the shift unit, the shift actuator affixed onto a surface of the prime mover.

26. A watercraft comprising a marine drive, a shift operating device and a control device, the marine drive comprising a drive unit supporting a propulsion device, a transmission coupled with the propulsion device, and a shift mechanism arranged to move the transmission between a first position in which the propulsion device is set to a first mode and a second position in which the propulsion device is set to a second mode, the shift mechanism comprising a shift unit movable between a first shift position and a second shift position, the transmission moving to the first position while the shift unit moves toward the first shift position, the transmission moving to the second position while the shift unit moves toward the second shift position, and an electrically operable shift actuator supported by the drive unit and having an actuating member coupled with the shift unit, the shift operating device providing a shift position command to the control device, the control device controlling the shift actuator to move the actuating member based upon the shift position command, the shift operating device having a control member movable between a first control position corresponding to the first shift position and a second control position corresponding to the second shift position, and a position sensor arranged to sense a control position of the control member or a shift position of the shift unit and to send a shift position command signal to the control device.

27. A watercraft comprising a marine drive, an internal combustion engine, a shift operating device and a control device, the marine drive comprising a drive body supporting a propulsion device powered by the engine, a transmission coupled with the propulsion device, and a shift mechanism arranged to move the transmission between a first position in which the propulsion device is set to a neutral mode and a second position in which the propulsion device is set to a propulsion mode, the shift mechanism comprising a shift unit movable between a first shift position and a second shift position, the transmission moving to the first position when the shift unit moves to the first shift position, the transmission moves to the second position when the shift unit moving to the second shift position, and an electrically operable shift actuator supported by the drive body and having an actuating member coupled with the shift unit, the shift operating device providing a shift position command to the control device, the control device controlling the shift actuator to move the actuating member based upon the shift position command, the shift operating device having a control member movable between a first control position corresponding to the first shift position and a second control position corresponding to the second shift position, and a neutral position sensor arranged to sense the control member placed at the first control position or the shift unit placed at the first shift position and to send a neutral position command signal to the control device.

28. The watercraft as set forth in claim 27, wherein the control device controls the engine not to start operating when the control device receives the neutral position command signal from the neutral position sensor.

* * * * *